US007081602B1

(12) United States Patent
Black

(10) Patent No.: US 7,081,602 B1
(45) Date of Patent: Jul. 25, 2006

(54) FAIL-SAFE, RESISTIVE-FILM, IMMERSION HEATER

(75) Inventor: Steven A. Black, Murray, UT (US)

(73) Assignee: Trebor International, Inc., West Jordan, UT (US)

( * ) Notice: Subject to any disclaimer, the term of this patent is extended or adjusted under 35 U.S.C. 154(b) by 29 days.

(21) Appl. No.: 10/899,903

(22) Filed: Jul. 27, 2004

Related U.S. Application Data

(63) Continuation-in-part of application No. 10/736,220, filed on Dec. 15, 2003, now abandoned, which is a continuation of application No. 10/218,194, filed on Aug. 12, 2002, now Pat. No. 6,674,053, which is a continuation of application No. 09/882,455, filed on Jun. 14, 2001, now Pat. No. 6,433,319, which is a continuation-in-part of application No. 09/738,724, filed on Dec. 15, 2000, now Pat. No. 6,580,061.

(60) Provisional application No. 60/179,541, filed on Feb. 1, 2000.

(51) Int. Cl.
*H05B 3/46* (2006.01)
*H05B 3/02* (2006.01)

(52) U.S. Cl. ..... 219/523; 219/522; 219/534; 219/548; 219/553; 392/480

(58) Field of Classification Search ..... None
See application file for complete search history.

(56) References Cited

U.S. PATENT DOCUMENTS 3,493,428 A 2/1970 Hedberg et al.
3,875,413 A * 4/1975 Bridgham ..... 250/492.1
3,960,564 A 6/1976 Molenaar et al.
4,004,052 A * 1/1977 Bystrova et al. ..... 427/374.7
4,072,243 A 2/1978 Conant et al.
4,091,267 A 5/1978 Grant
4,125,640 A 11/1978 Conant et al.
4,145,601 A 3/1979 Lavrentiev
4,401,879 A 8/1983 Shukla et al.
4,420,544 A 12/1983 Lawson et al.
4,479,074 A 10/1984 Bhalla
4,516,814 A 5/1985 Ireland
4,689,475 A 8/1987 Kleiner et al.
4,707,586 A 11/1987 Voss et al.
4,724,356 A * 2/1988 Daehler ..... 313/522
4,748,367 A 5/1988 Bloch et al.
4,859,505 A 8/1989 Nakayama et al.
4,889,974 A 12/1989 Auding et al.
4,946,546 A 8/1990 Bourgeois-Moine
4,948,707 A 8/1990 Johnson et al.
4,978,814 A 12/1990 Honour (Continued)

FOREIGN PATENT DOCUMENTS

JP 357119505 A 7/1982

(Continued)

*Primary Examiner*—Joseph M. Pelham
(74) *Attorney, Agent, or Firm*—Pate Pierce & Baird

(57) ABSTRACT

A heater comprising a conduit made of corundum (e.g. synthetic sapphire) and having a wall forming a closed cross-section with an interior surface, and an exterior surface. At least one of the interior and exterior surfaces may have a roughened portion comprising inclusions and corresponding protrusions formed substantially continuously therethroughout. An electrically resistive coating may extend substantially continuously over, in, and around the inclusions and protrusions of at least a part of the roughened portion to form a conformal cross-section having a thickness selected to promote bending thereof to accommodate annular expansion and contraction occurring in response to a differential in the coefficients of expansion between the electrically resistive coating and the conduit.

17 Claims, 22 Drawing Sheets

U.S. PATENT DOCUMENTS 5,039,840 A 8/1991 Boardman
5,057,674 A 10/1991 Smith-Johannsen
5,183,795 A 2/1993 Ting et al.
5,201,022 A 4/1993 Shifflett
5,315,063 A 5/1994 Auclair
5,388,177 A 2/1995 Ono et al.
5,448,037 A 9/1995 Takase et al.
5,493,102 A 2/1996 Takase et al.
5,498,853 A 3/1996 Gross et al.
5,573,692 A 11/1996 Das et al.
5,616,266 A 4/1997 Cooper
5,643,483 A 7/1997 Kubota et al.
5,648,125 A 7/1997 Cane
5,665,262 A 9/1997 Hajaligol et al.
5,667,712 A 9/1997 Sutorius et al.
5,750,958 A 5/1998 Okuda et al.
5,877,474 A 3/1999 Konishi
5,911,899 A 6/1999 Yoshikai et al.
5,942,343 A 8/1999 Chen
5,968,379 A 10/1999 Zhao et al.
5,971,402 A 10/1999 Northrop et al.
6,037,574 A 3/2000 Lanham et al.
6,130,601 A 10/2000 Brown et al.
6,141,870 A 11/2000 McDermott et al.
6,146,700 A 11/2000 Yuan et al.
6,172,344 B1 1/2001 Gordon et al.
6,222,166 B1 4/2001 Lin et al.
6,242,722 B1 6/2001 Provancha et al.
6,376,816 B1 4/2002 Cooper et al.
6,433,319 B1 8/2002 Bullock et al.
6,479,094 B1 11/2002 Black
6,486,447 B1 * 11/2002 Miyata ..... 219/444.1
6,544,583 B1 4/2003 Black
6,580,061 B1 6/2003 Black
6,674,053 B1 1/2004 Bullock et al.

FOREIGN PATENT DOCUMENTS

JP 363153280 A 6/1988

* cited by examiner

Section A

| Substrate | Melting Point (K) | Density ($kg/m^3$) | k (W/m K) 300 K | k (W/m K) 400 K |
|---|---|---|---|---|
| Crystalline Quartz 196a | | | | |
| Parallel to C Axis | 1883 | 2650 | 10.4 | 7.6 |
| Perpendicular to C Axis | 1883 | 2650 | 6.21 | 4.70 |
| Fused Quartz 196b | 1883 | 2220 | 1.38 | 1.51 |
| Sapphire 198 | 2323 | 3970 | 46 | 32.4 |

FAIL-SAFE, RESISTIVE-FILM, IMMERSION HEATER

RELATED APPLICATIONS

This Patent application is a continuation-in-part of and claims priority to U.S. patent application Ser. No. 10/736,220 filed on Dec. 15, 2003 now abandoned and entitled ELECTRICAL, THIN FILM TERMINATION, which is a continuation of Ser. No. 10/218,194, filed Aug. 12, 2002, now U.S. Pat. No. 6,674,053 issued Jan. 6, 2004 and entitled ELECTRICAL, THIN FILM TERMINATION, which is a continuation of Ser. No. 09/882,455, filed Jun. 14, 2001, now U.S. Pat. No. 6,433,319 issued Aug. 13, 2002 and entitled ELECTRICAL, THIN FILM TERMINATION, which is a continuation-in-part of Ser. No. 09/738,724, filed Jan. 15, 2000, now U.S. Pat. No. 6,580,061 issued Jun. 17, 2003 and entitled DURABLE, NON-REACTIVE, RESISTIVE-FILM HEATER, which claims the benefit of U.S. Provisional Patent Application Ser. No. 60/179,541 filed on Feb. 1, 2000 and entitled DURABLE, NON-REACTIVE, RESISTIVE-FILM HEATER.

BACKGROUND

1. The Field of the Invention

This invention relates to electrical heaters and, more particularly, to novel systems and methods for applying conductive coatings to substrates.

2. The Background Art

The semiconductor manufacturing industry relies on numerous processes. Many of these processes require transportation and heating of de-ionized (DI) water, acids, and other chemicals. By clean or ultra-pure is meant that gases or liquids cannot leach into, enter, or leave a conduit system to produce contaminants above permissible levels. Whereas other industries may require purities on the order of parts-per-million, the semiconductor industry may require purities on the order of parts-per-trillion. Ultra-pure may be considered to be a purity level having contaminants at concentrations of one hundred parts-per-billion or less.

Chemically clean environments for handling pure de-ionized (DI) water, acids, chemicals, and the like, must be maintained free from contamination. Contamination in a process fluid batch may destroy hundreds of thousands of dollars worth of product. Several difficulties exist in current systems for heating, pumping, and carrying process fluids (e.g. acids, DI water). Leakage into or out of a process fluid conduit must be tightly controlled and preferably eliminated. Moreover, leaching and chemical reaction between any contained fluid and the carrying conduits must be tightly controlled and preferably eliminated.

Elevated temperatures in semiconductor processing are often over 100 C, and often sustainable over 120 C. In certain instances, temperatures as high as 180 C may be approached. It is preferred that all process fluid heating and carrying mechanisms virtually remove the possibility of contact with any metals, regardless of the ostensibly non-reactive natures of such metals. It is desirable to prevent process fluid contamination, even in the event of a catastrophic failure of any element of a heating, transfer, or conduit system.

Conventional immersion heaters place a heating element, typically sheathed in a coating, directly into the process fluid. The heating element and process fluid are then contained within a conduit. Temperature transients in immersion heaters may overheat a sheath up to a melting (failure) point.

A failure of a sheath may directly result in metallic or other contamination of the process fluid. Meanwhile, temperature transients in radiant heaters may fracture a rigid conduit.

A heating alternative is needed that does not have the risks associated with conventional radiant and immersion-heating elements. A system is needed that is both durable and responsive for heating process fluids. Failure that may result in fluid contamination is an unacceptable risk.

BRIEF SUMMARY AND OBJECTS OF THE INVENTION

It is a primary object of the present invention to provide a heater for handling process fluids at elevated temperatures in the range of 0 C to 180 C. It is an object of the invention to provide a heater having electrical resistance heating in close proximity to a process fluid for heating by conduction and convection without exposing process fluids to contamination, even if electrical failures or melting of conductive paths should occur within a heater.

Consistent with the foregoing objects, and in accordance with the invention as embodied and broadly described herein, a method and apparatus are disclosed in one embodiment of the present invention as including a heater comprising a substrate. The substrate may be formed of a material having suitable strength, heat transfer characteristics, non-reactivity, and coating adherence. The substrate may function to separate a heating element from the fluid to be heated. The substrate may have any suitable shape to promote efficient heat transfer to the fluid passing thereacross. In certain embodiments, the substrate may be formed as a conduit to transfer the fluid.

In one embodiment, the substrate is one or more tubes of quartz. In such an embodiment, the tubes may be abutted end-to-end with an adapter (e.g. fluorocarbon fitting) fitted to transfer the fluids between two tubes in a series. One pass or passage, comprising one or more tubes of quartz in a series, may be fitted on each end to a manifold (e.g. header/footer) comprised of a fluorocarbon material properly sealed for passing liquid into and out of the individual passage.

Individual tubes or conduits may improve the temperature distribution therein by altering the internal boundary layer of heated fluids passing therethrough. In one embodiment, a baffle tube, within the outer tube, may have a plug serving to center the baffle in the heating tube. The plug may restrict flow, such that the fluid inside the baffle does not change dramatically. Thus an annular flow between the baffle tube and the outer heating tube may maintain a high Reynolds number in the flow, enhancing the Nusselt number, heat transfer coefficient and so forth. Moreover, the temperature distribution may be rendered nearer to a constant value across the annulus, rather than running with a cold, laminar core. In one embodiment, a heater may be manufactured by depositing, plating, or otherwise adhering a resistive coating or layer to a surface of the substrate. The resistive coating may be any material having a proper balance of conductivity, resistivity, and adherence. In certain embodiments, the substrate surface may be roughened or otherwise prepared to promote adherence of the resistive coating thereto. In one embodiment, electroless nickel may be plated on a roughened (textured) surface of the substrate.

A resistive, conductive coating may extend along any selected length of the substrate. The resistive coating may be configured to connect in series or to multi-phase power along the length of a single substrate. In one embodiment, a quartz tube may be roughened, etched, dipped, coated, and protectively coated. The quartz tube need not be heated to sinter the conductive layer. The conductive coating may be plated as a continuous ribbon of well-adhered, resistive, conducting, metallic material.

The electrical length of the heated portion (i.e. the area coated with the resistive coating) may be adjusted by application of an end coating for distributing current. Electrical current may be applied to the end the coating or directly to the resistive coating by any suitable termination. In selected embodiments, a electrical lead may be soldered directly to the end coating. In other embodiments, a conductor may be applied against the end coating. The conductor may be formed of multiple conductive strands. The strands may be formed to distribute mechanical and electrical loads substantially evenly across (typically circumferentially in the case of a cylindrical tube) the entire termination zone. The size of the termination zone area may be selected to provide an acceptable current density such that thermal and mechanical loads do not become excessive at any one location.

In one embodiment, the conductor may be a braided strap. A clamp may urged the conductor against the end coating, resistive coating, or some other interface layer applied to the substrate. The clamp may maintain the conductor against the underlying surface, while accommodating expansion with temperature, without harming mechanical bonds between the resistive coating and the substrate.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in the FIGS. 1 through 24, is not intended to limit the scope of the invention, as claimed, but is merely representative of the presently preferred embodiments of the invention.

The presently preferred embodiments of the invention will be best understood by reference to the drawings, wherein like parts are designated by like numerals throughout. Those of ordinary skill in the art will, of course, appreciate that various modifications to the detailed schematic diagram may easily be made without departing from the essential characteristics of the invention, as described in connection with the Figures. Thus, the following description of the Figures is intended only by way of example, and simply illustrates certain presently preferred embodiments consistent with the invention as claimed herein.

Figure 1:
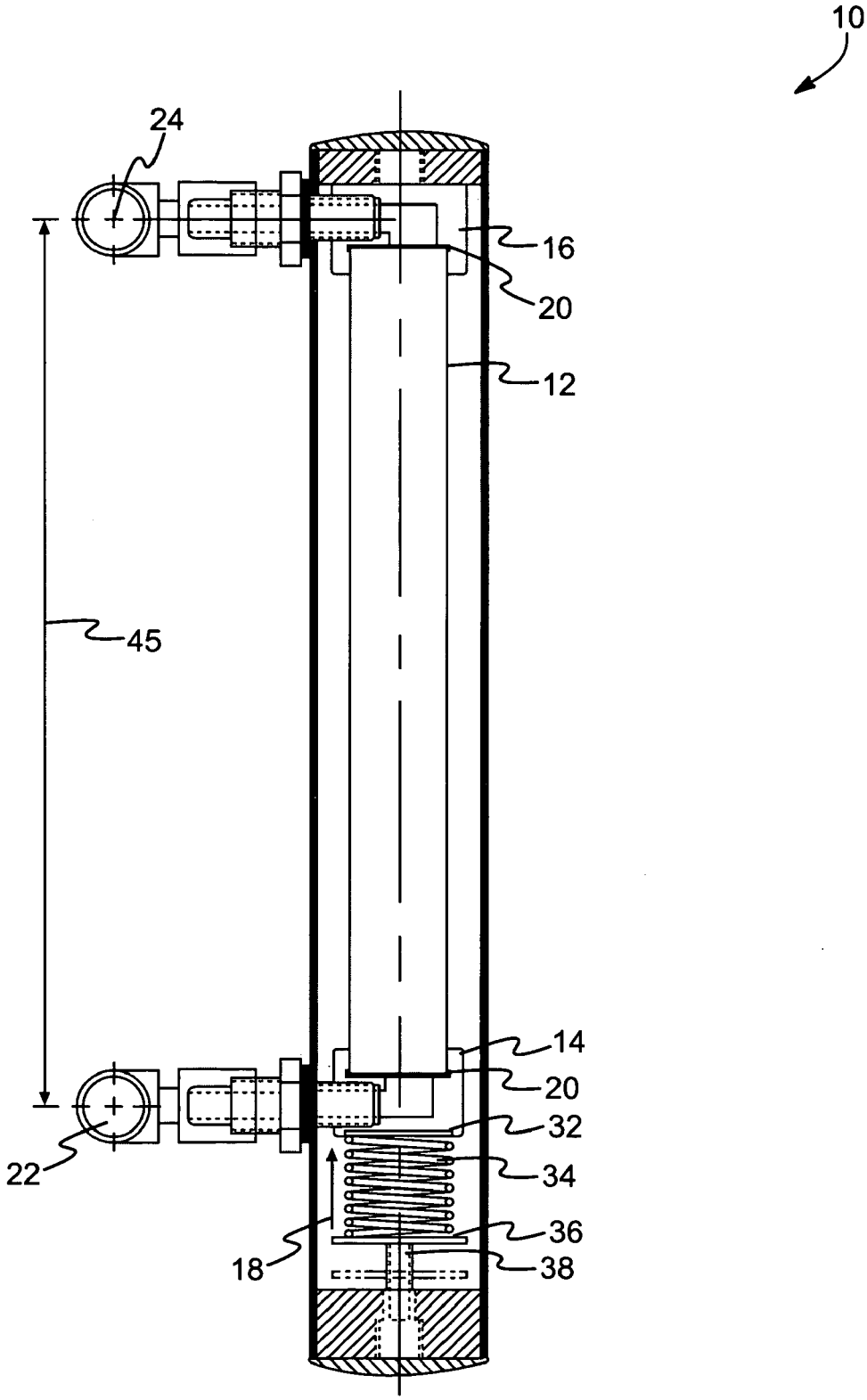
FIG. 1 is a side elevation view of a heater unit in accordance with the invention.
Figure 2:
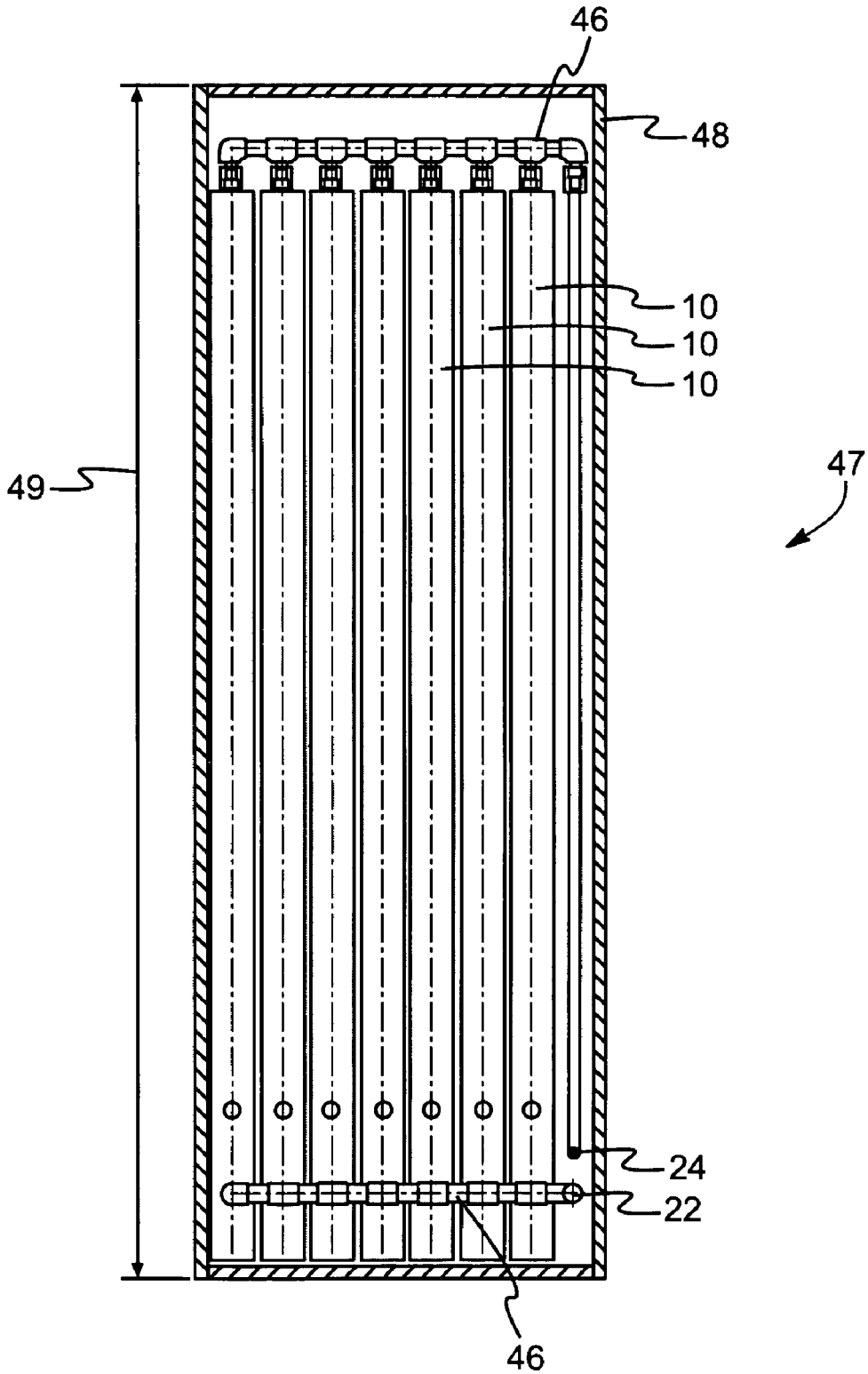
FIG. 2 is a front elevation view of a heater assembly including multiple units of the apparatus illustrated in FIG. 1.
Figure 3:
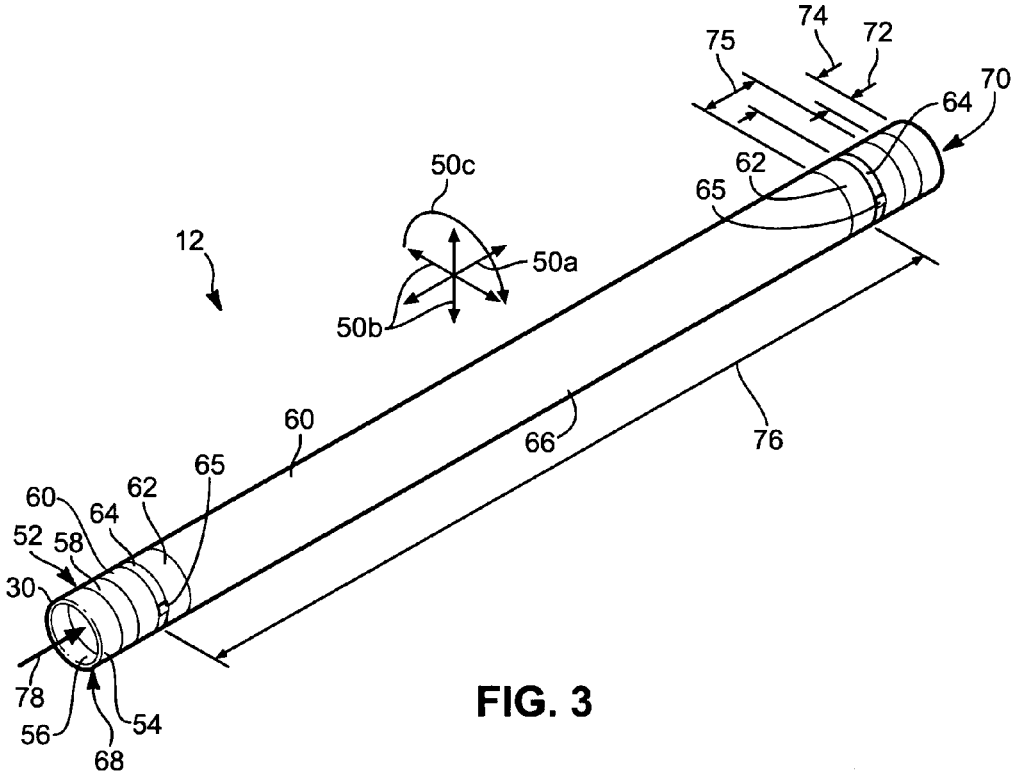
FIG. 3 is a perspective view of one embodiment of a coated conduit in accordance with the invention.

Referring to FIGS. 1–3, an apparatus 10 may be created for heating or otherwise handling process fluids such as those used in the semiconductor industry. The semiconductor-processing industry requires ultra-pure, de-ionized (DI) water, acids, and the like. A conduit 12 may be formed of a comparatively rigid material such as quartz, sapphire, or the like.

Fused quartz and sapphire have minimal coefficients of thermal expansion and resist distortion due to changes in temperature and time, providing dimensional stability and repeatable structural properties. Additionally, these materials are substantially non-reactive with processing fluids and meet industry parts-per-billion (or even trillion) purity requirements in acids and water, such as de-ionized water.

Fittings 14, 16 may support the conduit 12 and apply force 18 from a pressure plate 32, loader (e.g. spring) 34, baseplate 36 and adjuster 38 to support a suitable seal 20. An inlet 22 and outlet 24 may convey fluid along the length 45 of the apparatus 10 from a manifold 46. A plurality of the individual apparatus 10 may be assembled as a heater 47 in a cabinet 48 or outer frame 48 enclosing an outer envelope 49.

The heater 47 does not expose metals to the process fluid inside the conduits 12. In one embodiment, a resistive coating on the conduit 12 heats the conduit 12. The heat passes through the wall of the conduit 12 into the process fluid therein.

Referring to FIG. 3, a conduit 12 may be formed of a crystalline material. In general, a conduit 12 may be of any suitable shape. For example, a flat plate may be fitted, as a window, or the like, against a structure suitable for sealing the window. A coating may be applied to such a substrate. Accordingly, the term conduit 12, may include any substrate, of any shape, suitable for receiving a coating for generating electrical resistance heating on a side opposite to that exposed to a fluid to be heated.

The conduit 12 may define an axial direction 50*a* and radial directions 50*b*. A wall 52 of the conduit 12 may extend in an axial direction 50*a* and circumferentially 50*c*. The wall 52 may define, or be defined by, an outer surface 54 and an inner surface 56.

In selected embodiments, an outer surface 54 may be treated, such as by mechanical etching, to provide a portion of textured (roughened) surface 58. The textured surface 58 may be prepared by a mechanical abrasive action, such as grit blasting, bead blasting, sandblasting, grinding, centerless grinding, and the like. Accordingly, in a crystalline material, such as quartz or sapphire, small crystalline chunks may be removed from the surface 54, leaving small, angular, crystalline inclusions in the surface 54.

The techniques and materials used in the preparation and coating of the outer surface 54 may be used to coat an inner surface 56. For example, the wall 52 may be treated to provide texturing of the inner surface 56. Concentric conduits 12 provide additional heating. In such an embodiment, the inside surface 56 of the inner conduit 12 may be provided with a heater 10 while the outside surface 54 of the outer conduit 12 is provided with another heater 10. The fluid may then be heated at both the inner flow and outer flow extremes without being exposed to any potential contamination.

The coating 60 may typically be a substantially continuous film 60 extending over the area of the substrate to which the heat is to be applied. In a heating conduit 12 embodiment, the coating 60 may extend axially 50*a* and circumferentially 50*c* about the outer surface 54. An end coating 62, applied over the basic coating 60, may be formed of the same material, a similar material, or a material having different mechanical properties. The end coating 62 may be of any suitable material selected to maintain mechanical integrity and adherence between the coating 60 and the textured surface 58.

In certain embodiments, the end coating 62 may be applied by a method other than depositing or plating. In alternative embodiments, the end coating 62 may simply be additional material, identical to the coating 60. The end coating 62 may decrease the resistance of the coating 60 by providing increased cross-sectional area along a portion of the length. Thus, the end coating 62 effectively shortens the resistive coating 60.

The end coating 62 may provide less resistance along a given direction 50*a*, 50*c* than the resistive coating 60. That is, the end coating 62 may include more material per unit of area or better conductivity in order to distribute electricity from a connector lug 64 in an axial 50*a* and a circumferential direction 50*c*. Thus, the end coating 62 becomes a distributor or a manifold for electricity provided to a lug 64 or connector 64 suitable for receiving a wire delivering current to the resistive coating 60.

A protective coating 66 of a suitable, conformal material may be applied to reduce scratching, wear, and chemical reaction of the resistive coating 60, thus extending the operational lifetime thereof. The applied coatings 60, 62, 66 need not extend from end 68 to end 70 of the substrate 12. A distance 72 of smooth surface 54 may remain in order to support sealing of the ends 68, 70 as described herein. Smooth, fired, quartz formed in a lip 30 may provide sealing, strength, manufacturing, and handling advantages.

A lug 64 or band 64 may serve as a base 64 for a connection 65 for electrical power inputs. The lug 64 may be spaced a selected distance 74 from either end 68, 70 of the conduit 12. An end coating 62 of conductive material may distribute electricity to the resistive coating 60. The end coating 62 may be placed at any suitable location along the length of the of the conduit 12.

Electricity travels between the bands 64 and end coatings 62 along a resistance length 76. Power dissipation for heating requires current and resistance. The resistivity and conductivity of the coating 60 may be selected and balanced to generate a desired wattage dissipation per unit area. Accordingly, the resistivity and conductivity of the coating 60 may be controlled by selecting coating 60 thickness and length 76.

The coating 60 may be designed and applied within parameters engineered to balance several factors. For example, if the textured surface 58 is too rough, the conduit 12 may fail under test pressures. If insufficiently rough, the textured surface 58 may provide inadequate adhesion forces between the resistive coating 60 and the outer surface 54 (or inner surface 56, if applicable) of the conduit 12 or substrate 12.

The resistive coating 60 may be benefitted from uniformity of conductivity and cross-sectional area along the length 76 in an axial direction 50*a*. An excess of the coating 60 may promote unitary (e.g. rigid body) motion thereof. With the application of thermal and mechanical loads, the unitary motion of the resistive coating 60 may mechanically separate the resistive coating 60 from the textured surface 58. This may be particularly evident when dealing with material having different coefficients of thermal expansion.

Ceramics, crystals, and other materials, such as quartz and sapphire, have very low coefficients of thermal expansion. In contrast, most metals provide substantial expansion with increased temperature. Accordingly, at elevated temperatures, the coating 60 tends to expand and separate as a continuous annulus surrounding the conduit 12.

At a microscopic level, the coating 60 tends to shear away from the microscopic inclusions developed in the textured surface 58. Thus, a balance in application of the coating 60 is required to balance the forces due to thermal expansion with the mechanical bond between the coating 60 and the inclusions in the textured surface 58.

The effective resistance of the coating 60 changes as the coating 60 is heat treated. Heat treatment does not melt the deposited coating 60. Nevertheless, metallurgical grain boundaries form, grow, and affect electrical conductivity in the coating 60. If the effective resistance is too high, the heater 10 may not provide sufficient energy input through the wall 52 into a fluid flow 78. If the resistance is too low, the heater 10 may provide an output outside the desired range of control. In some apparatus, excessive heating may damage equipment, including fracturing solids as a result of differentials in thermal expansion.

The end coating 62, if applied too thickly, may overcome the adhesion or other bonding between the end coating 62 and the resistive coating 60. Alternatively, the end coating 62 may maintain a sufficient bond with the coating 60, but separate the coating 60 from the textured surface 58. This is particularly common if either the resistive coating 60, end coating 62, or their combination is too thick and mechanically rigid. Similarly, as with the resistive coating 60, applying the end coating 62 too thinly, tends to reduce the average number of atoms at any site, yielding poor uniformity, and inadequate process control for reliable current conduction.

Excessive resistance in the end coating 62 may generate too much heat. Excessive heat may destroy the connection between the end coating 62 and the resistive coating 60, or separate both from the textured surface 58.

A lug 64 or connector band 64 may be secured with the same considerations required for the coatings 60, 62. Namely, excess material may provide excessive strength and generate unitary motion. Additionally, insufficient material may create hot spots. The lug 64 or connector band 64 materials may be selected to provide flexibility, malleability, elasticity, or plasticity to comply with the coatings 60, 62.

Figure 4:
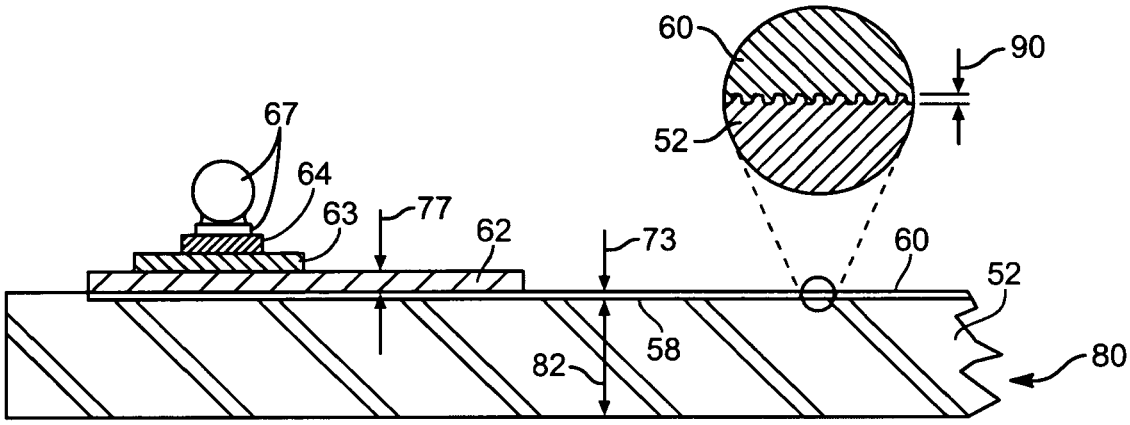
FIG. 4 is a schematic, side elevation, cross-section view of a portion of the apparatus of FIG. 3, illustrating the comparative positions of the substrate, resistive coating, end plating (coating), and connection scheme for introducing electricity to the apparatus.

Referring to FIG. 4, a wall 52 may be thought of as a substrate 80. Thus, a substrate 80 may generalize a conduit 12 into any particular shape, open, closed, and so forth. As discussed, a thickness 82 of a substrate 80 provides mechanical integrity and strength in a conduit 12. In use, the conduits 12 may have internal pressure loads applied thereto. Excessive thickness 82 may generate a stress differential between the inner and outer surfaces 56, 54. Additionally, the thickness 82 may be affected by the inclusions in the textured surface 58. The thickness 82 may benefit from being sufficiently large in comparison to the inclusions of the textured surface 58, thus mitigating the risk of crack propagation.

The thickness 73 of the resistive coating 60 may be precisely controlled. The thickness 73 may be on the order of numbers of atoms up to a few millionths of an inch. In selected embodiments, the thickness 73 is selected to be within an order of magnitude of the size of inclusions in the textured surface 58. In an alternative embodiment, the thickness 73 may be selected to be more than an order of magnitude smaller than the size of inclusions in the textured surface 58. Accordingly, the coating 60 may appear like a crepe material. This crepe may be a thin, crinkly film following the peaks and valleys of the inclusions formed in the textured surface 58.

Thermal expansion due to a rise in temperature may be accommodated by localized bending of portions of the coating 60. If the thickness 73 becomes too great, however, the coating 60 behaves as a beam extending in the circumferential direction 50*c* and the axial direction 50*a*. Accordingly, the beam may change diameter, applying comparatively large radial forces withdrawing the small irregularities from their places filling the inclusions in the textured surface 58.

Excellent thermal contact between the coating 60 and the conduit 12 requires superior adhesion by selecting an appropriate thickness 73. The thickness 73 may be successfully selected to provide mechanical compliance with the textured surface 58 while providing uniformity. Thus, the selection of the resistive material 60, thickness 73, and substrate thickness 82 may be used to control heat input for a fluid flow 78 while maintaining mechanical integrity and thermal conductivity.

An interface layer 63 may be selected from materials softer than the coating 60. Selecting an interface layer 63 material that is comparatively malleable and thin, while having comparatively higher electrical conductivity than the coating 60, may produce suitable mechanical and electrical integrity.

A roughness level or inclusion height 90 may be detected by the reflection of light or sheen of the roughened surface 58. The roughness height 90 dramatically affects the sheen of the roughened surface 58, even with comparatively minimal roughness 90. Thus, the adequacy of the roughness height 90 may be detected as well as gauged by a visual inspection.

Excessive roughness height 90 may result from removing too much of the wall 52 from the textured surface 58. Controlling grit size (e.g. bead size) and time of application may provide a suitable roughness height 90. The roughness height 90 should accommodate mechanical lodgment of atoms of the coating 60 within inclusions in the surface. Thus, micro-mechanical anchors grip the thin coating 60 and maintain it against the outer surface 54 (or inner surface 56).

The quality of the roughness height 90 may be additionally be gauged by the crystalline sharpness and angularity of the inclusions. Spalling of substrate 12 material from the outer surface 54 under the influence of grit, bead, or sand blasting, grinding, centerless grinding, or the like may tend to break the substrate along crystal boundaries. In this manner a fully randomized set of inclusions, including concavities overhung by sharp crystalline corners, may be provided. Such inclusions may securely capture pockets of atoms of the coating 60.

The resistive path of the coating 60 may be affected by the roughness height 90. A smooth outer surface 54 tends to provide a direct current path. A textured surface 58, provides an indirect path over hills and valleys of the inclusions formed in the textured surface 58. Thus, providing too great a thickness 73 of the resistive coating may decrease resistivity reducing the heating dissipation below a desired value.

Figure 5:
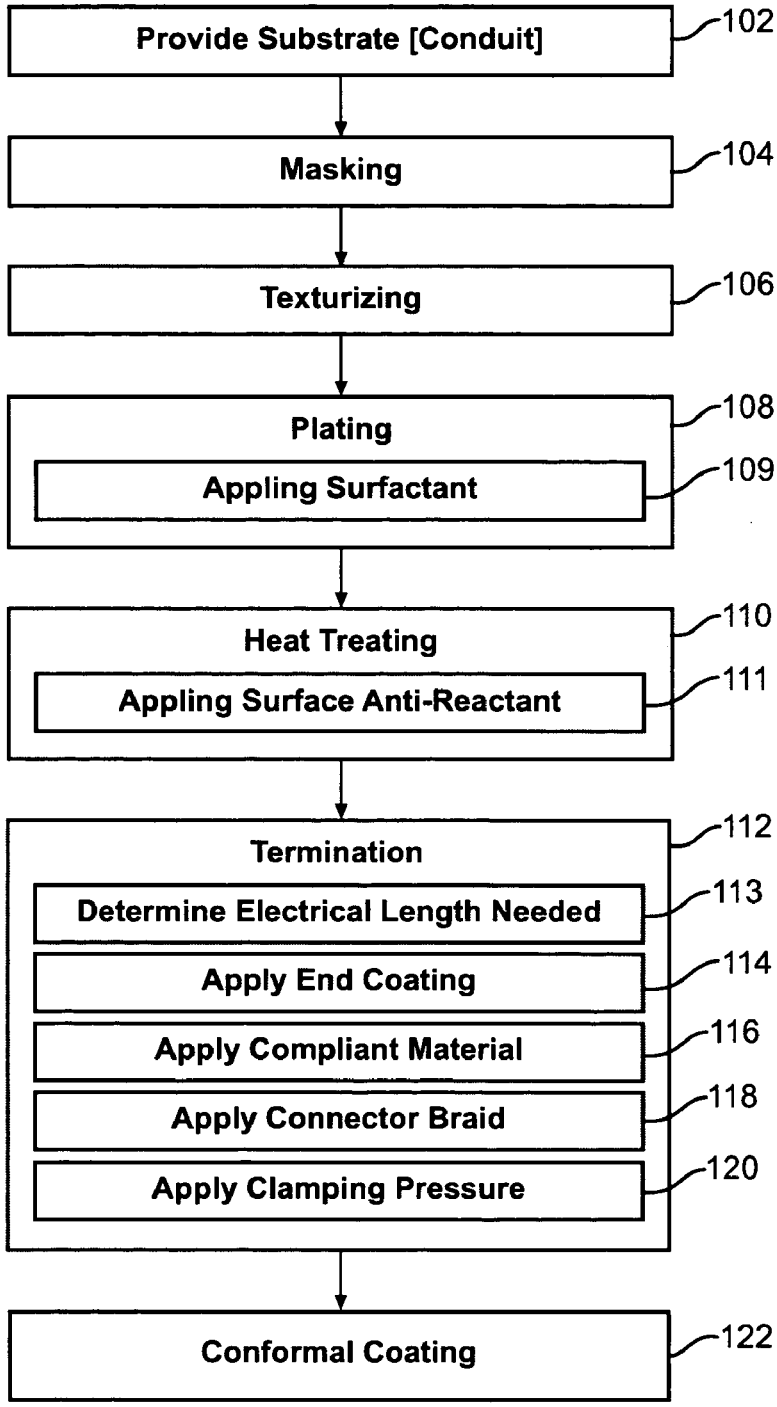
FIG. 5 is a schematic block diagram of one embodiment of a process for making a heating unit in accordance with the invention.

Referring to FIG. 5, a method for manufacturing the heater 10 in accordance with the present invention may include providing 102 the conduit 12 or other substrate 80, followed by suitable masking 104 and texturing 106. Texturing 106 may include bead blasting, sand blasting, grit blasting, grinding, centerless grinding, or etching by other means. In selected embodiments, bead blasting may provide considerable uniformity in the fracture mechanics of forming inclusions in a substrate without sacrificing mechanical integrity thereof. The texturing 106 may provide mechanical grip, as discussed hereinabove. The roughness height 90 may be selected to create inclusions that will not compromise the mechanical integrity of the conduit 12.

The wall thickness 82 may be selected to balance heat transfer and structural advantage. Thermal gradients may be considered in view of the substrate thickness 82 and thermal stresses created by changing temperatures of the apparatus 10.

A thin film 60 is applied in a plating process 108. In one embodiment, electroless nickel plating forms a suitable resistive coating 60. The plating process 108 may be continued for a time selected to provide a desired thickness 73. The thickness 73 of the resistive coating 60 may be selected to balance current-carrying capacity of the coating 60, mechanical stiffness and strength limits required to maintain adhesion, and coating uniformity. In certain embodiments, balancing involves adjusting the thickness 73 of the resistive coating 60 to achieve uniformity of performance, either mechanical, thermal, electrical, or a combination thereof.

The plating process 108 may be selected from, for example, vapor deposition, sputtering, painting, sintering, powder coating, and electroless plating. In electroless plating, such as electroless nickel plating, application 109 of a surfactant may greatly improve the quality of the coating 60. Application 109 of a surfactant may involve a surfactant scrub 109 in which vigorous application of force breaks down any pockets of gas that might adhere to concavities in the textured surface 58. Thereafter, the coating 60 may form, maintaining a continuous mechanical structure about the inclusions of the textured surface 58.

After the resistive coating 60 has been applied 108, it may be advantageous to heat treat 110 the substrate 12 and coating 60. In one embodiment, the heat-treating process 110 involves a metallurgical heat treatment 110. Such a process 110 does not elevate temperatures sufficiently to melt the metallic coating 60. Rather, temperatures are elevated, raising the energy level of various atoms within the coating 60, to encourage migration of interstitial materials. Migration of interstitial materials may foster growth of various grain boundaries. Growth of grain boundaries affects the binding of electrons into orbitals of various atomic or molecular structures. Thus, the heat-treating process 110 may substantially affect electrical conductivity. Accordingly, the time and temperature of the heat treatment process 110 may provide a control over the effective electrical resistivity of the coating 60.

In certain embodiments, heat treating 110 may include a surface treatment. In one embodiment, an application 111 or deposition 111 (e.g. spray, painting, vapor deposition, etc.) of a surface-protecting layer may include adding a composition (e.g., a silicate) to the heat-treatment environment. The application process 111 may include masking portions of the coating 60 that may later be coated with additional conductive materials. The protective process 111 provides a non-reactive coating or passivating coating to reduce oxidation of the resistive coating 60 during heat treating 110.

Following the heat-treating process 110, a termination process 112 provides end coatings 62. The placement of the termination may be influenced by a determination of the electrical length 113 needed to provide appropriate heating. In certain embodiments, the termination process 112 may include application 114 of a termination coating 62 or end coating 62 to reduce the resistance of the heater 10. Resistance may typically be reduced by half an order of magnitude. The thickness 77 of the end coating 62 may be balanced to provide substantially uniform current distribution, without compromising the mechanical integrity of the bond between the conductive-resistive materials 60 and the conduit 12 or substrate 80.

In selected embodiments, the termination process 112 may involve application 114 of an end coating 62 having a specific length 75 calculated to provide a precise power delivery in the heater 10. Similarly, a soft, compliant, conductive material may be added 116 over a portion of the end coating to form an interface layer 63 for receiving a connector 65. The connector 65 may be any suitable electrical connection. In one embodiment, the connector 65 is an electrical lead 65 electrically secured to the interface layer 63 or some other underlying layer (e.g. end coating 62, conductive coating 60). In an alternative embodiment, the band 64 may be formed to transfer electricity to the conductive coating 60. In such an embodiment, a braid 64 may be applied 118. After application of the braid 64, a clamping mechanism 67 may be applied. The clamp 67 may be adjusted (e.g. tightened) to apply a clamping pressure 120. The clamping pressure may urge the braid 64 against the underlying layers. A protective, conformal coating 66 may be applied 122 following, or as part of, the termination process 112.

Figure 6:
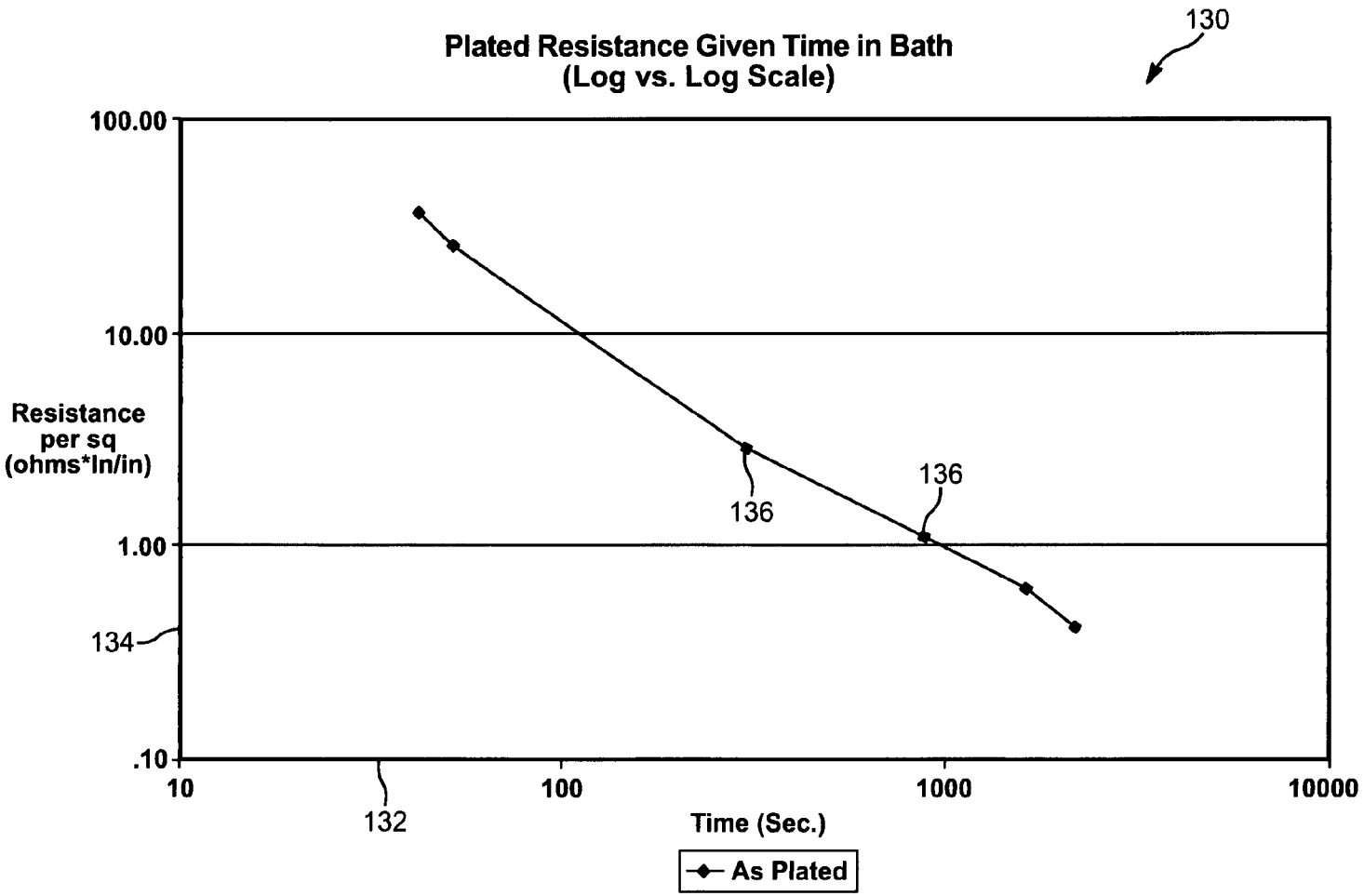
FIG. 6 is a graph illustrating a relationship between a bath time in a plating composition, illustrating the effect of normalized resistance per square in ohm-inches per inch.

Referring to FIG. 6, a graph 130 having a time axis 132 and resistance axis 134 illustrates various experimentally derived data points 136. The values 136 characterize the effect of time, during plating, on the initial resistance 134 of the coating 60. The scales are logarithmic. Thus, the process results in resistance being dependent upon a power of time. The relationship does not appear to change dramatically at any point on the graph 130.

Figure 7:
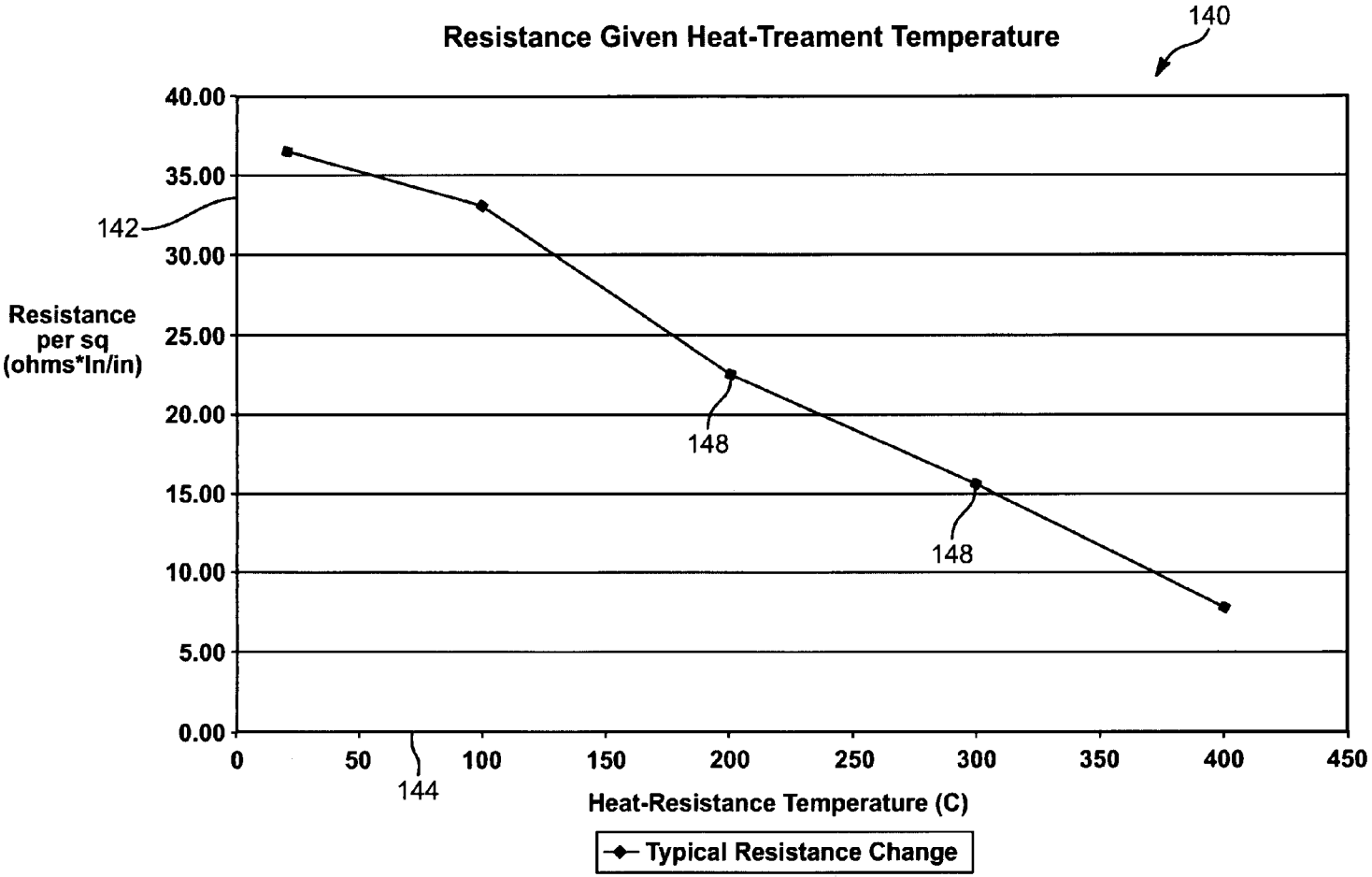
FIG. 7 is a graph illustrating a comparison between terminated resistance and watt density in a heater in accordance with the invention as a function of the cured resistance of a coating in accordance with the invention, further illustrating typical termination resistance adjustment depending upon the cured resistance of a conductive and resistive coating.

Referring to FIG. 7, a graph 140 of a resistance in a range 142 corresponds to a value of heat-treat temperature in a domain 144 of temperatures for the coating 60. The values 148 reflect the adjustment of resistance in ohm-inches per inch, due to a particular temperature during heat treating of the coating 60. The resistance of the coating 60 may vary due to variations in controlled parameters, such as the time and temperature associated with heat treatment. Parametric controls may vary during the plating process, and the heat-treating process 110. Thus, FIG. 7 reflects an ability to adjust the effective resistance of the apparatus 10 according to the heat-treat temperature.

Figure 8:
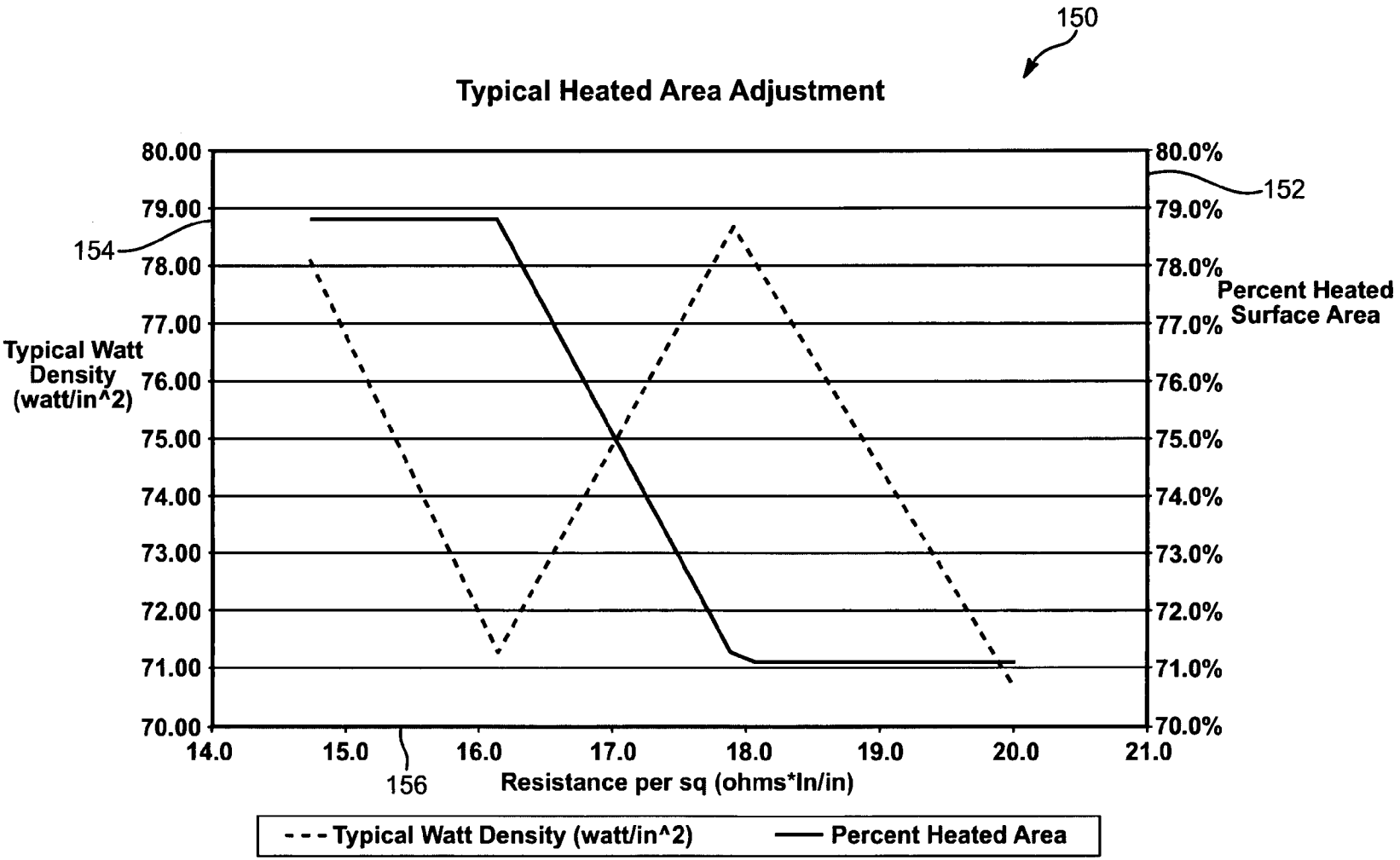
FIG. 8 is a chart illustrating a change in heating area (function of termination distance), in order to correct for variations in cured (heat treated) resistance values in a resistive coating of an apparatus in accordance with the invention.

Referring to FIG. 8, a graph 150 shows both a percentage 152 of available surface area heated by the coating 60 and a watt density 154 as a function of resistance per square 156. The graph 150 shows the correction ability for any given resistivity resulting from the heat-treat process 110. That is, given a particular value of the cured resistance 156, a final percentage 152 of area to be heated (powered) may be determined. Thus, the exact locations of the end coatings may be designed to obtain the desired heated area. Similarly, for a particular cured resistance 156, a watt density 154 may be determined. These results illustrate the influence that the end termination process 112 can have on correcting the overall value of resistance of the coating 60 in an apparatus 10.

Figure 9:
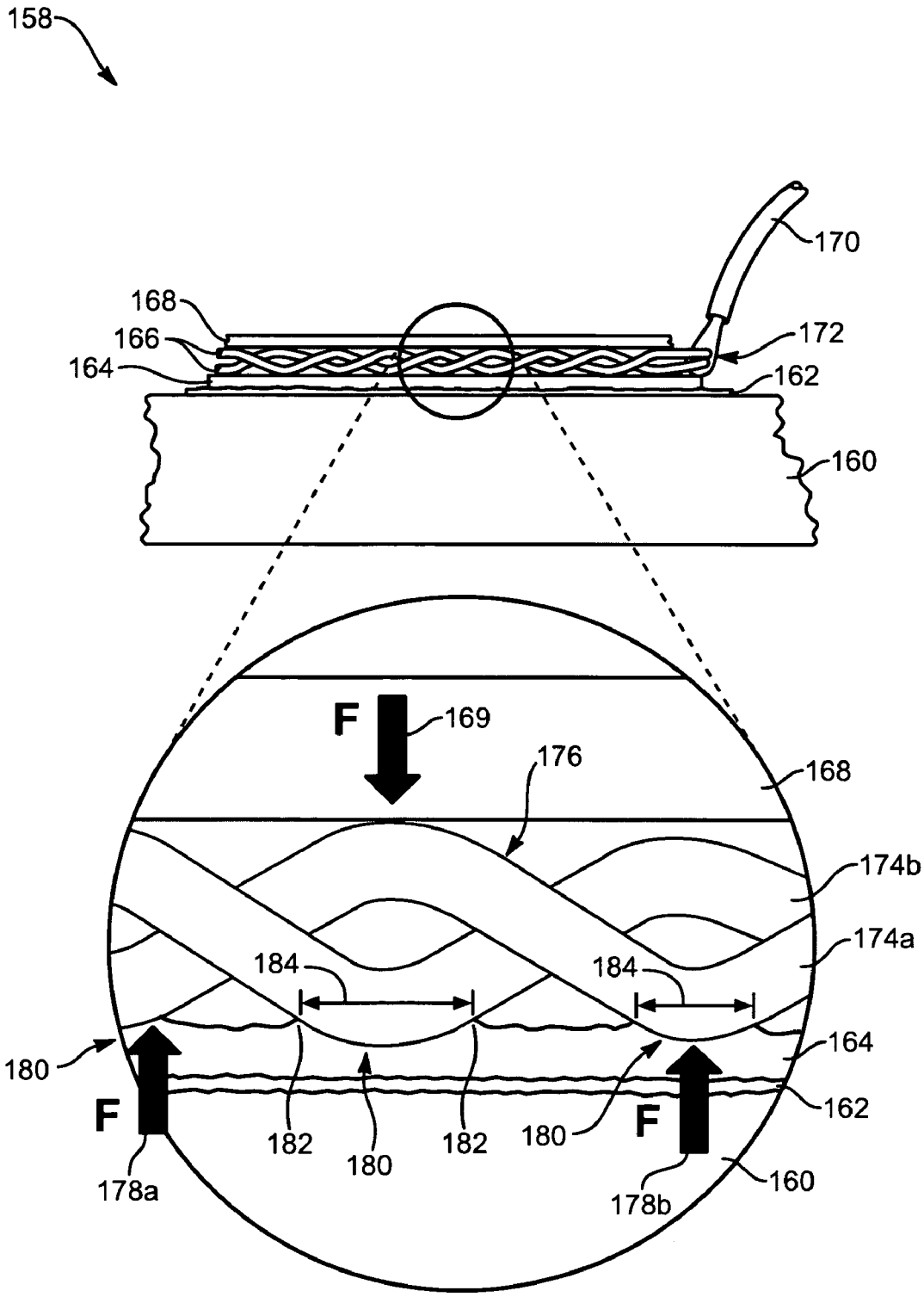
FIG. 9 is a side elevation of a termination in accordance with the present invention.
Figure 10:
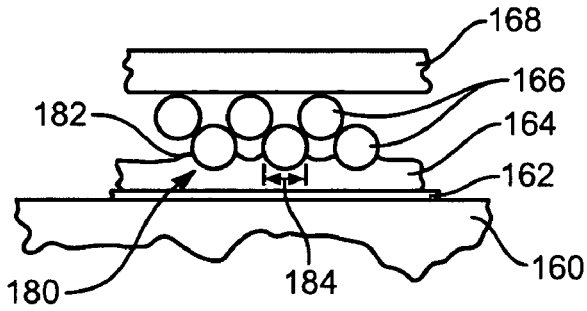
FIG. 10 is section view of the termination illustrated in FIG. 9.
Figure 10:
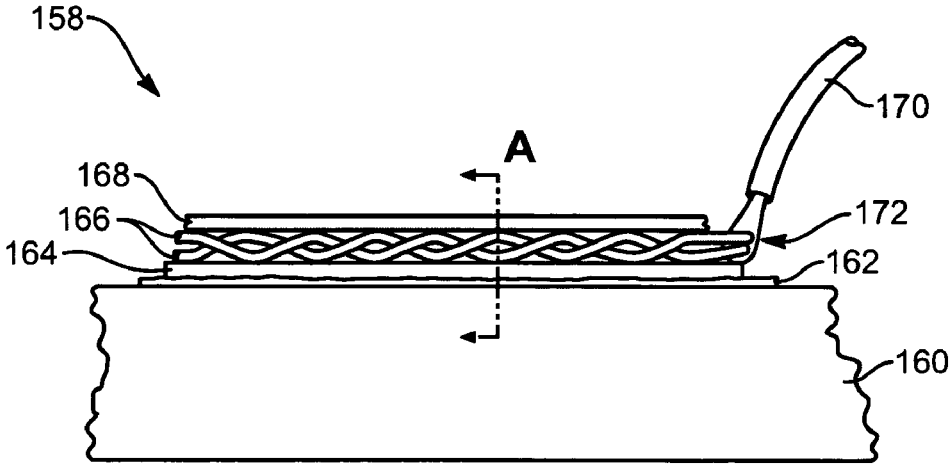

Referring to FIGS. 9 and 10, as discussed hereinabove, a balance exists between the ability of the resistive coating 60 to provide the proper heat dissipation and the ability to maintain mechanical adherence to the substrate 80. As a result, it may be advantageous to have a termination 158 that does not interfere with the mechanical and electrical integrity of the underlying coatings (e.g. resistive coating 60, end coating 62, or interface layer 63) during fabrication or operation.

A termination 158 may distribute mechanical and electrical loads so that load densities are substantially evenly distributed and within acceptable limits and tolerances. Mechanical loads may include all forces, such as shear, tensile, compression, expansion, contraction, and the like, that may be imposed on or by a termination 158. Electrical loads may include voltage differentials, current densities, and the like. Electrical loads and the heating that may accompany them, often cause material expansion and give rise to mechanical loads (e.g. forces, stresses). Acceptable tolerances may be defined as a level of mechanical and electrical loading that provides an acceptable termination. The tolerance levels may include a safety factor to provide a more reliable result.

FIGS. 9 and 10 illustrate an embodiment of a termination 158 that may provide the desired mechanical and electrical load distribution. Such a termination 158 may cooperate with a substrate 160. The substrate 160 may be a material selected to meet desired chemical inactivity, heat transfer, strength, rigidity, durability, electrical, mechanical, adhesion, or thermal expansion characteristics. In selected embodiments, the substrate 160 is fused quartz, sapphire, or the like.

The substrate 160 may be prepared to receive a conductive coating 162. As discussed hereinabove, the substrate 160 may be prepared by a mechanical abrasive action, such as grit blasting, bead blasting, sandblasting, grinding, centerless grinding, or a similar process. The conductive coating 162 may be applied by a suitable method such as plating, depositing, vapor deposition, sputtering, painting, sintering, powder coating, electroless plating, or the like. A suitable material may be chosen as the conductive coating 162.

The material may be selected to provide the desired electrical resistivity, electrical conductivity, mechanical strength, adherence to the substrate, or durability. In certain embodiments, the conductive coating 162 comprises nickel applied by an electroless plating process. In other embodiments, other metals, such as gold, silver, copper, alloys thereof, other conductors, etc., having suitable resistance may be used at suitable thicknesses.

In selected applications and embodiments, it may be beneficial to provide an interface layer 164 to extend over the area to which the termination 158 is to be applied. The interface layer 164 may provide a selectively deformable layer to receive a conductor 166. A clamp 168 may apply a mechanical load 169 to the conductor 166 to ensure an effective electrical contact between the conductor 166 and the underlying surface (e.g. interface layer 164). A lead 170 in intimate contact may deliver an electrical load to the conductor at an attachment point 172.

The conductor 166 may be formed to provide mechanical load distribution. For example, the conductor 166 may be formed of multiple strands 174. The strands 174 may be crimped, bent, twisted, woven, or otherwise formed to produce multiple points of contact between themselves and the clamp 168 and/or between themselves and the underlying surface (e.g. interface layer 164). Moreover, formation processes (e.g. crimping, weaving, twisting, etc.) of the strands 174 may effectively create multiple deflectable springs 176. In the illustrated embodiment, the strands 174 are woven to effectively form leaf springs 176 (fibers 176). In such a configuration, a strand 174*a* and the leaf spring 176 formed therein, may distribute a mechanical load 169 applied by a clamp 168 to create at least two smaller loads 178. In a similar manner, the smaller loads 178 may be distributed, by contact between interleaving fibers 176 (leaf springs 176), thus further propagating the applied load 169 to other locations.

As previously discussed, electrical loads and the heating that may accompany them often cause thermal expansion of materials and give rise to substantial mechanical loads. In many applications, where materials in intimate contact have different coefficients of thermal expansion, expansion may range from undesirable to catastrophic. For example, an expanding conductor 166 may apply excessive hoop stresses to the conductive coating 162, causing it to separate radially from the lower-expanding or non-expanding substrate 160. Additionally, expansion of the conductor 166 may cause uneven distribution of electrical loads, resulting in hot spots. Hot spots are undesirable for many reasons, including variations in conductivity, electrical overheating, burnout, mechanical distortions and delamination, or failure of the termination 158.

The conductor 166 may be formed to distribute thermal expansion, or even redirect it, thus limiting net movement between the conductor 166 and any adjacent material (e.g. interface layer 164, clamp 168). For example, the conductor 166 may be formed of multiple strands 174. The strands 174 may be crimped, bent, twisted, woven, or otherwise formed to produce multiple tortuous paths. The tortuous paths of the strands 174 may create multiple deflectable springs 176 (e.g. leaf springs 176). Upon expansion or contraction of the material of the strands 174, the springs 176 may deflect to absorb the displacement motion induced by the change in physical size. The result may be a substantially limited net expansion of the conductor 166 with respect to its surroundings. This embodiment may be particularly suited for terminations 158 involving several materials with differing coefficients of thermal expansion.

As discussed hereinabove, it may be beneficial to have an interface layer 164. The interface layer 164 may be formed of a suitable material selected to provide a desired combination of adherence, elasticity, plasticity, resistance, and conductivity. The material of the interface layer 164 may be selected to adhere to an underlying coating (e.g. conductive coating 162) without damaging the coating or causing the separation thereof during thermal cycling. The interface layer 164 may also provide a balance of elasticity and plasticity. This balance may support effective electrical contact between the interface layer 164 and the conductor 166. In selected embodiments, the interface layer 164 may be a comparatively thin deposit of solder 164, providing substantially no effective rigidity to the underlying conductive coating 162.

In certain embodiments, the interface layer 164 may elastically deflect and plastically yield locally around contact points 180. As a load 169 is applied, the conductor 166 may embed itself into the interface layer 164 a distance effective to provide increased electrical contact area therebetween. Displaced interface material 182 may form around each fiber 176 (spring 176) increasing the contact area 184 about the principal contact point 180 or contact region 180. Larger contact areas 184 promote lower local electrical resistance and, therefore, decreased heat generation. As discussed, decreased heat generation may reduce thermal expansion and the risk of overheating. The elasticity of the interface layer 164, as well as the lateral bends and resilience of the conductor 166 (fibers 176) may combine to maintain effectively constant electrical contact throughout thermal cycling of operational use. In such a manner, mechanical and electrical loads may be distributed to resist overheating, separation, de-lamination, or other forms of failure.

The conductor 166 may be made of multiple strands 174. The strands 174 may be formed to move, expand, shift, or otherwise reposition substantially independently from one another. That is, movement of one strand 174*a* does not necessarily require movement of a neighboring strand 174*b*. A conductor 166 in accordance with the present invention may be formed from one or more strands 174. The strands 174 may be formed of a suitable material having the desired conductivity, elasticity, malleability or formability, and durability. The conductor 166 may be coated with a material selected to discourage bonding, galling, or sticking thereof to a surrounding surface (i.e. surfaces with which the conductor 166 is in contact). Silver may operate to improve conductivity and resist galling. In one embodiment, the conductor 166 is a braided strap 166 made of copper strands 174 coated with silver to reduce adherence to an interface layer 164 of solder.

Other films, layers, coatings, or the like may intersperse between the conductive coating 162, interface layer 164, and conductor 166. These coatings (e.g. end coatings 62) may adjust the resistivity of the conductive coating 162, enhance adherence, reduce separation, increase durability, or otherwise enhance the operation of the apparatus 10. The elements of a termination 158 in accordance with the present invention may be applied in conjunction with these other films.

Figure 11:
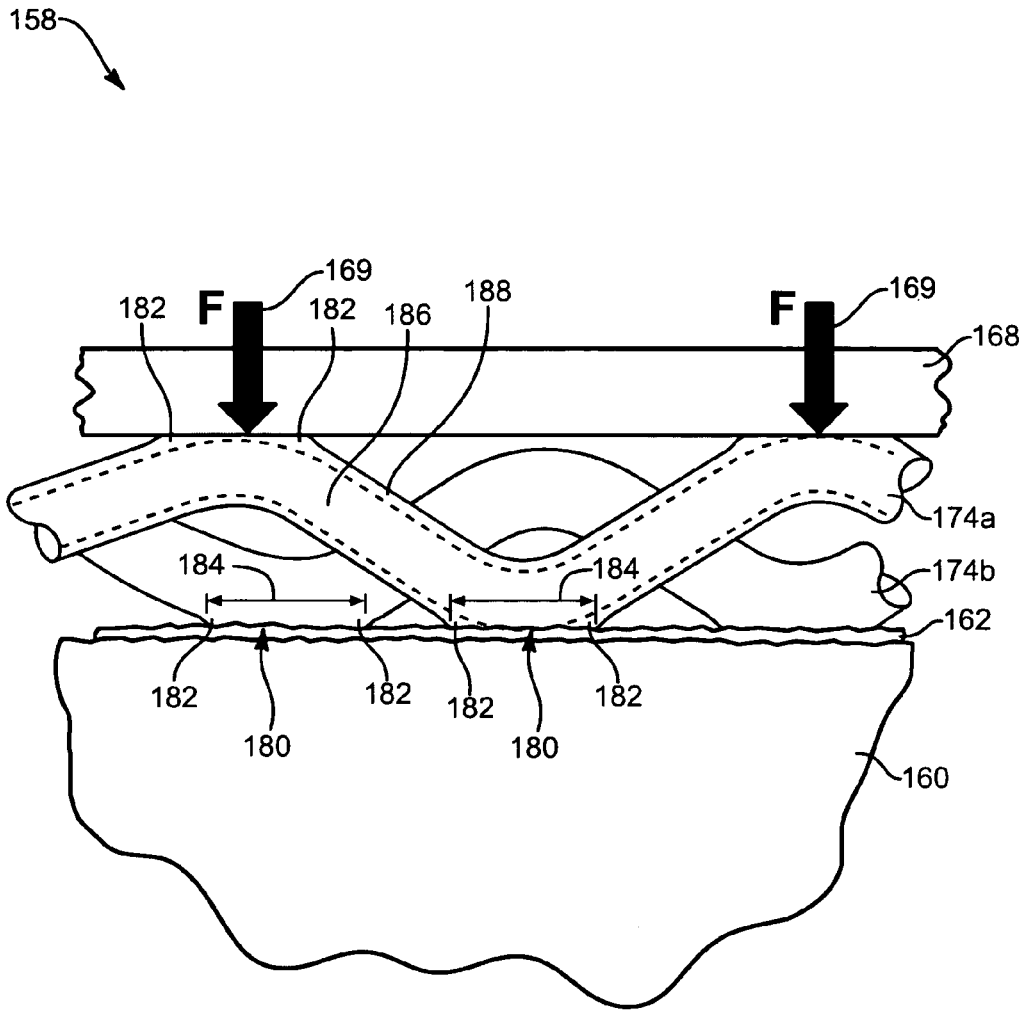
FIG. 11 is a side elevation view of an alternative embodiment of a termination in accordance with the present invention.

Referring to FIG. 11, in an alternative embodiment, the interface layer 164 may be omitted. The conductor 166 may include an electrically conductive interior 186 and a compliant exterior 188. The conductive interior 186 may provide the mechanical resilience for the load-distributing spring effect described hereinabove. As a load 169 is applied, the compliant exterior 188 may deform to match the surface against which it is being pressed. Displaced exterior material 182 may increase the contact area 184 of the contact points 180.

Figure 12:
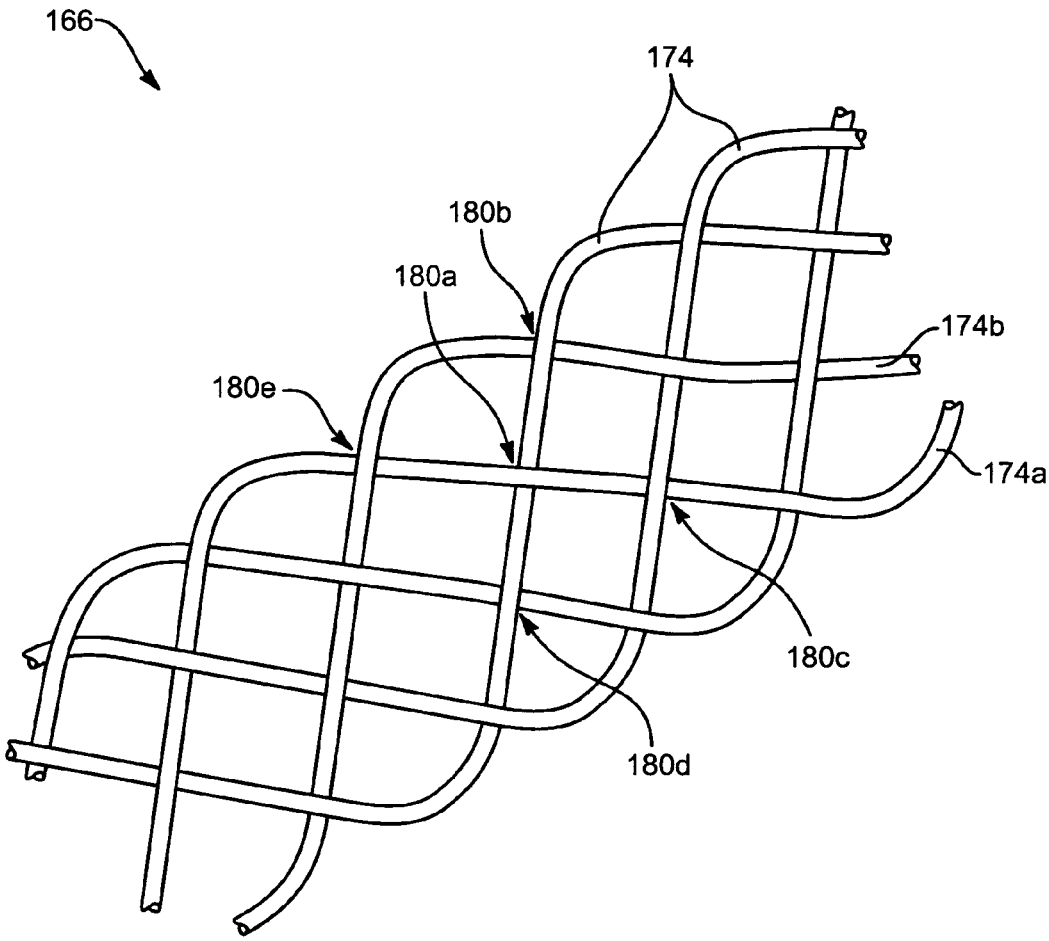
FIG. 12 is plan view of an embodiment of a termination conductor in accordance with the present invention.

Referring to FIG. 12, a conductor 166 in accordance with the present invention may be formed to distribute electrical loads. As discussed hereinabove, hot spots are undesirable because they may result in electrical overheating, burnout, or other failure modes of the termination 158. Distributing electrical loads may greatly reduce the occurrence of hot spots. In selected embodiments, electrical load distribution may be accomplished by a woven or braided conductor 166.

A braided conductor 166 may be made of several conductive strands 174. Each strand 174 may conduct only a fraction of the electrical current of the whole termination 158. As a result, a contact point 180*a* of reduced or increased electrical resistance on a strand 174*a* likely will not draw a large portion of the total current applied to the conductor 166 nor be allowed to develop a voltage drop likely to support an arc. Additionally, the decreased resistance of a parallel electron path from a neighboring strand 174*b* to strand 174*a* may compensate for the variation in resistance of the contact point 180*a* thus, reducing the likelihood that an electron will find any path of significantly higher or lower resistance through a neighbor of any contact point 180*a*.

When a contact point 180*a* is not actually in contact with the underlying surface (e.g. interface layer 164), electrons may be imparted to the underlying surface at the many neighboring contact points 180*b*, 180*c*, 180*d*, and 180*e* maintaining low resistance and low voltage drops. In this manner, the occurrence of cold spots, areas of less than average current, or gaps subject to arc, may be reduced.

Figure 13:
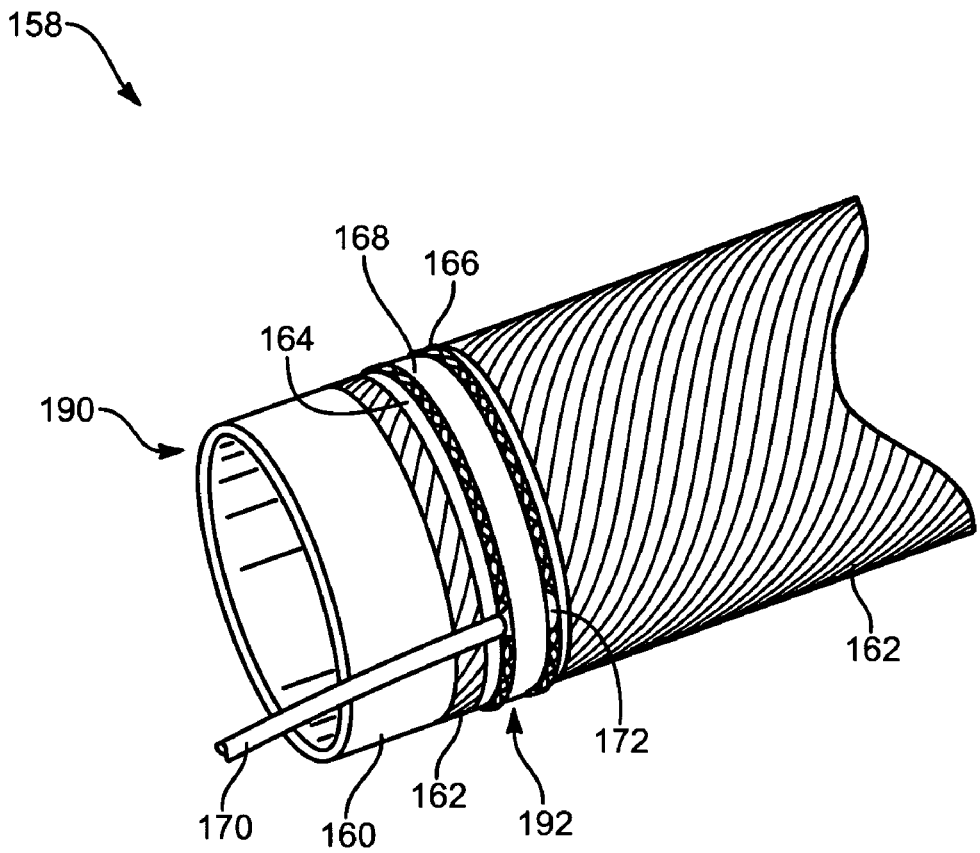
FIG. 13 is a perspective view of a termination in accordance with the present invention as applied to a conduit for heating fluids passing therethrough.

FIG. 13 illustrates one selected embodiment of a termination 158 in accordance with the present invention. A substrate 160 may be formed into a cylindrical conduit 190. The substrate 160 may be prepared and then coated with a conductive coating 162 for providing a pre-determined balance of resistance and current flow. An interface layer 164 may be placed over the conductive coating 162 in the termination zone 192. In the illustrated embodiment, the termination zone 192 is a circular continuous band. A conductor 166 (e.g. a braided strap) may be placed directly against the termination zone 192 to encircle the conduit 190.

A lead 170 may conductively secure (e.g. by solder or other mechanical joint) to the conductor 166 at an attachment point 172. A clamp 168 may circumferentially encircle the conductor 166 and maintain a contact force of each strand 174 against the interface layer 164 in a direction normal to the surface. The clamp 168 may be a comparatively strong clamp 168 circumferentially configured to flex enough to equalize radial stresses. In selected embodiments, the conductor 166 may be scored or otherwise shaped to create a channel 194 or circumferential indentation 194 to facilitate rapid alignment and assembly of the clamp 168.

Figure 14:
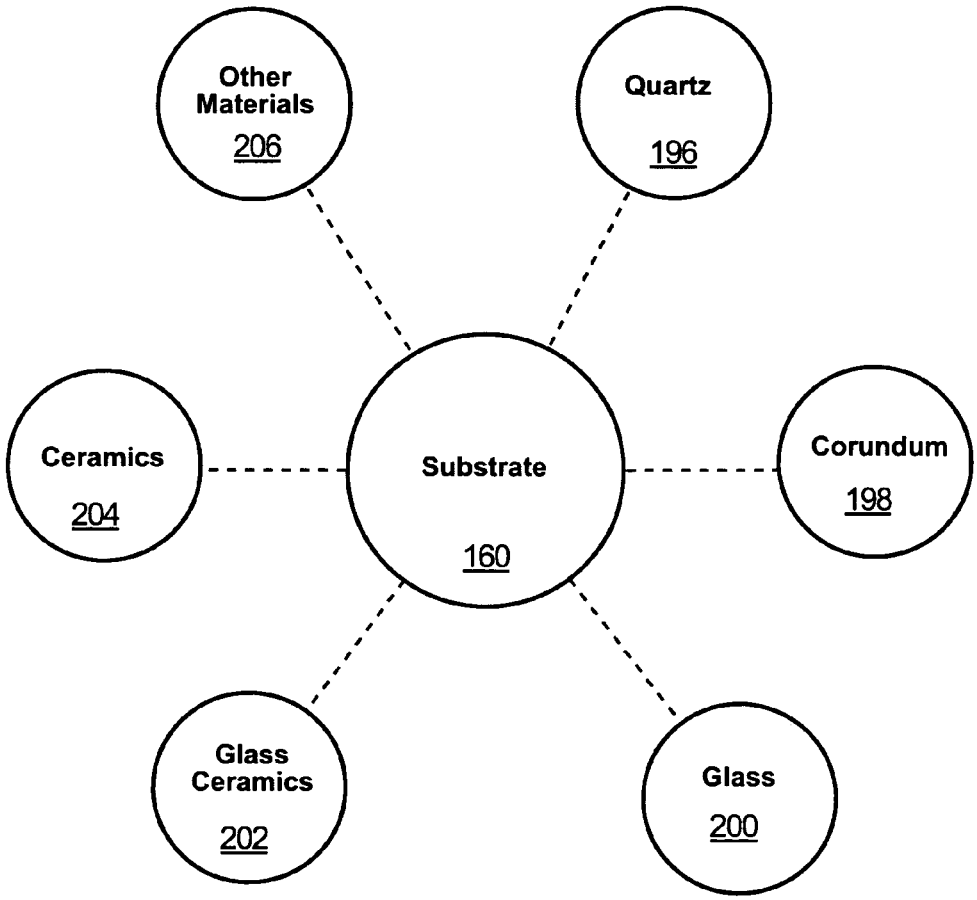
FIG. 14 is a diagram illustrating various materials that may be suitable for use as a substrate in accordance with the present invention.

Referring to FIG. 14, as discussed hereinabove, a substrate 80, 160 may be any material selected to meet desired chemical inactivity, heat transfer, strength, rigidity, durability, electrical, mechanical, adhesion, or thermal expansion characteristics. In selected embodiments, the substrate 80, 160 may be quartz 196. Quartz 196 is silicon dioxide, $SiO_2$, which may be crystalline or amorphous. Quartz 196 may be a suitable substrate 80, 160 due to its chemical stability, dielectric characteristics, and low coefficient of thermal expansion.

In other embodiments in accordance with the present invention, corundum 198 may provide a suitable substrate 80, 160. Corundum 198 is aluminum oxide, $Al_2O_3$. In its transparent varieties, corundum 198 may be referred to as ruby or sapphire, depending on the trace components such as chromium, iron, and titanium that determine the color. Ruby is transparent, red corundum 198, while sapphire is generally transparent, blue corundum 198. However, sapphire may be yellow, pink, etc. In its pure form, corundum 198 is transparent and colorless. Due to its hardness, non-transparent (e.g. non-gemstone) varieties of corundum 198 are often used in abrasives.

Corundum 198 may be crystallized naturally or synthetically. At times, synthetic corundum 198 may be referred to as sapphire 198 or synthetic sapphire 198. Currently, there are multiple methods available to form rods, tubes, and other shapes from corundum 198 in a single, synthetic crystal. Corundum 198 may be a suitable substrate 80, 160 due to its chemical stability. For example, it is one of the few materials that is impervious to hydrofluoric acid (HF). Corundum 198 also has a very low coefficient of thermal expansion, excellent dielectric characteristics, and comparably good thermal conductivity.

In certain embodiments in accordance with the present invention, a substrate 80, 160 may be formed of glass 200. Glass 200, while containing silicon dioxide, contains significant quantities of other constituents as well. The additional components typically act to lower melting temperatures, improve workability, and the like. Glass 200 may be a suitable substrate 80, 160 in certain embodiments due to its ease of formability, electrical resistance, and low cost.

In selected embodiments, ceramic glass 202 may be a suitable substrate 80, 160. Ceramic glass 202 may be a blend of crystalline and amorphous structure. Ceramic glass 202 may be made by holding a glass structure at a selected temperature to permit the formation of crystalline structure within the material. When the growth of the crystalline structure reaches a desired point, the temperature of the material may be changed to terminate the formation. The crystalline structure may limit the tendency of ceramic glass 202 to expand or contract with changes in temperature. Ceramic glass may also have desirable dielectric characteristics, machinability, low cost, and the like.

If desired, ceramics 204 may be used as substrates 80, 160 in accordance with the present invention. Ceramics 204 may be suitable due to their thermal and dielectric characteristics. Other materials 206 having the desired chemical inactivity, thermal conductivity, density, strength, rigidity, durability, electrical properties, mechanical properties, and the like may also be used for a substrate 80, 160.

Figures 15, 16:
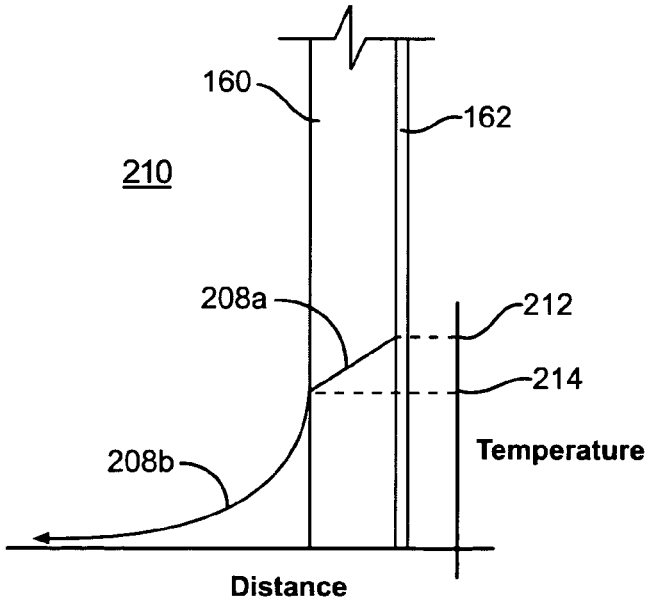
FIG. 15 is a table presenting various physical properties of crystalline quartz, fused quartz, and sapphire (e.g. corundum)
FIG. 16 is a graph plotting steady-state temperature versus distance as a heater in accordance with the present invention conducts heat to a substrate, which in turn conducts heat to a fluid.

Referring to FIG. 15, the thermal properties of crystalline quartz 196*a* vary depending upon which axis of the crystal is being tested. Fused quartz 196*b*, on the other hand, is isotropic. Fused quartz 196*b* melts at approximately 1883 K and has a density of approximately 2220 kg/m$^3$. At 300 K, fused quartz 196*b* has a thermal conductivity of approximately 1.38 W/m·K. At 400 K, fused quartz 196*b* has a thermal conductivity of approximately 1.51 W/m·K.

Sapphire 198 is also isotropic. Sapphire 198 melts at approximately 2323 K and has a density of approximately 3970 kg/m$^3$. At 300 K, sapphire 198 has a thermal conductivity of approximately 46 W/m·K. At 400 K, sapphire 198 has a thermal conductivity of approximately 32.4 W/m·K. In the range from 300 K to 400 K, sapphire 198 conducts heat anywhere from twenty to thirty times better than fused quartz 196*b*. Such properties may be taken into account when choosing a substrate 80, 160.

Referring to FIG. 16, the thermal conductivity of a substrate 80, 160 may affect the temperature gradient 208*a* imposed. Steady-state temperature gradients 208*a* in solids (i.e. substrate 160) are linear while steady-state temperature gradients 208*b* in fluids (i.e. fluid 210) are exponential. For a given substrate thickness 82, the greater the thermal conductivity, the less the temperature gradient 208*a* (i.e. the smaller the difference between the heater temperature 212 and the fluid interface temperature 214). For a given set of heating requirements and dimensions, a substrate 80, 160 of corundum 198 permits a resistive heating, conductive coating 60, 162 to operated at a lower temperature 212 than does a substrate 80, 160 of fused quartz 196*b*, while maintaining the same fluid interface temperature 214. Lower heater operating temperatures 212 may increase electrical efficiency as well as heater life.

Figure 17:
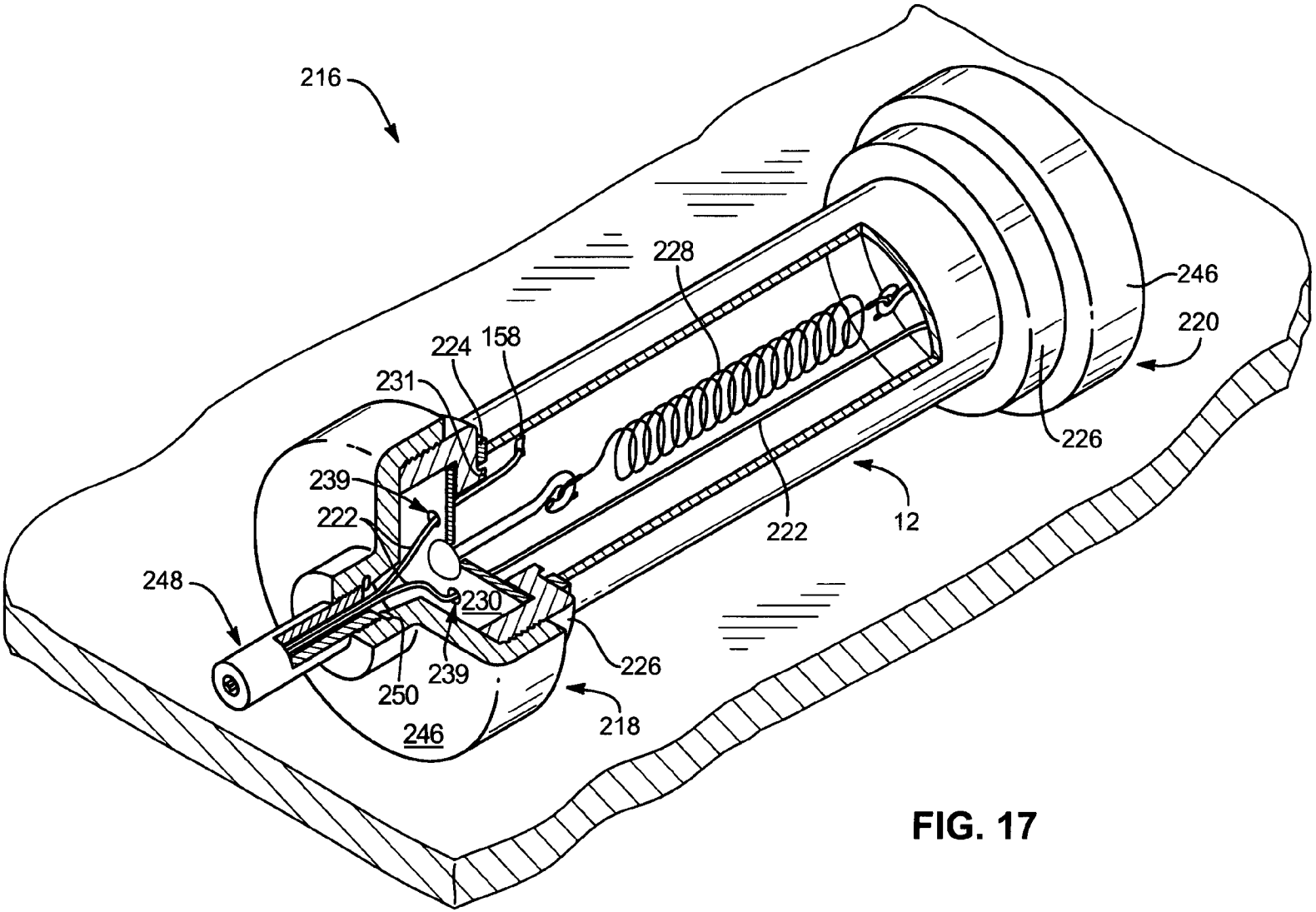
FIG. 17 is a partially cutaway, perspective view of an immersion heater in accordance with the present invention.
Figure 18:
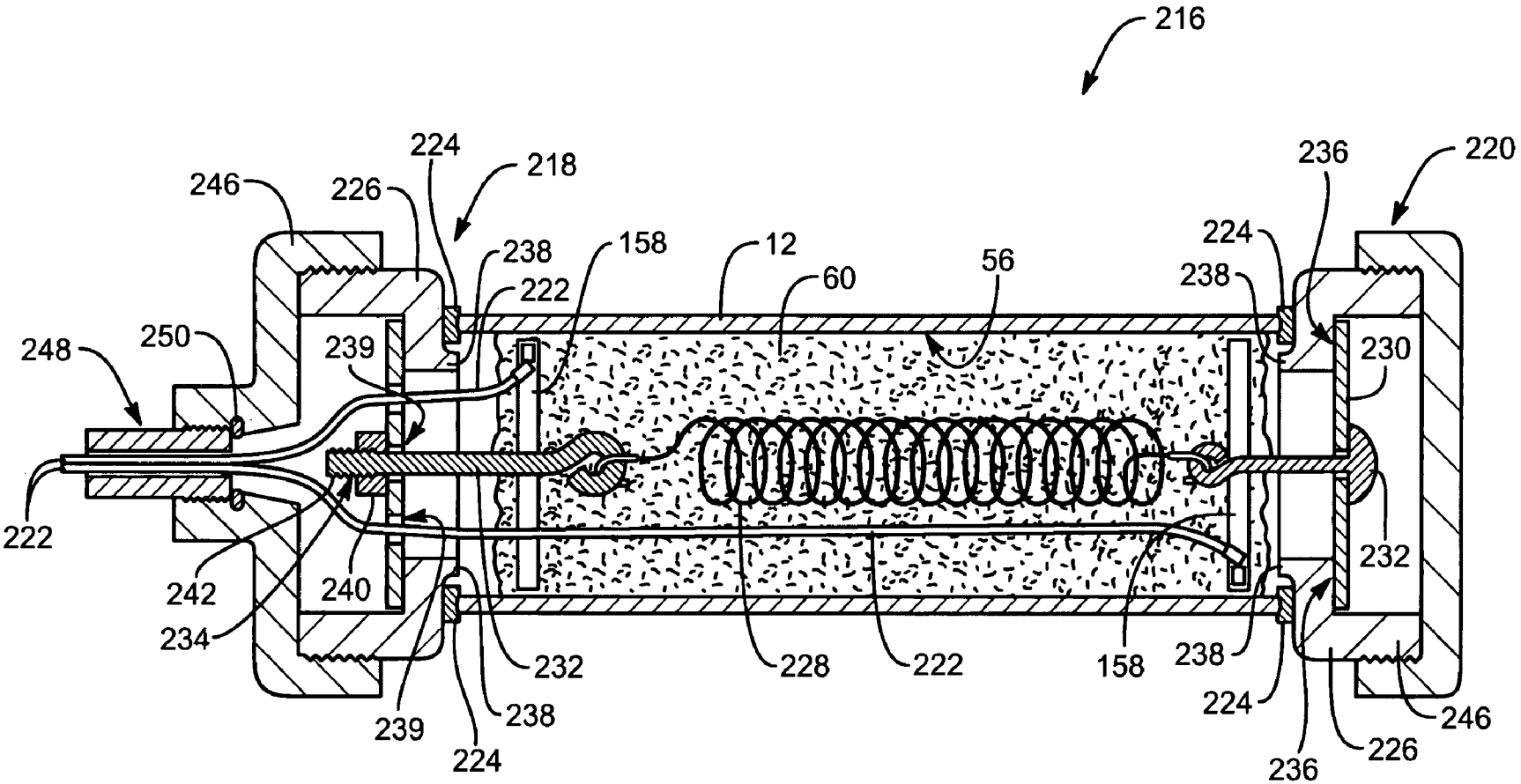
FIG. 18 is a side elevation, cross-sectional view of the immersion heater of FIG. 17.
Figure 19:
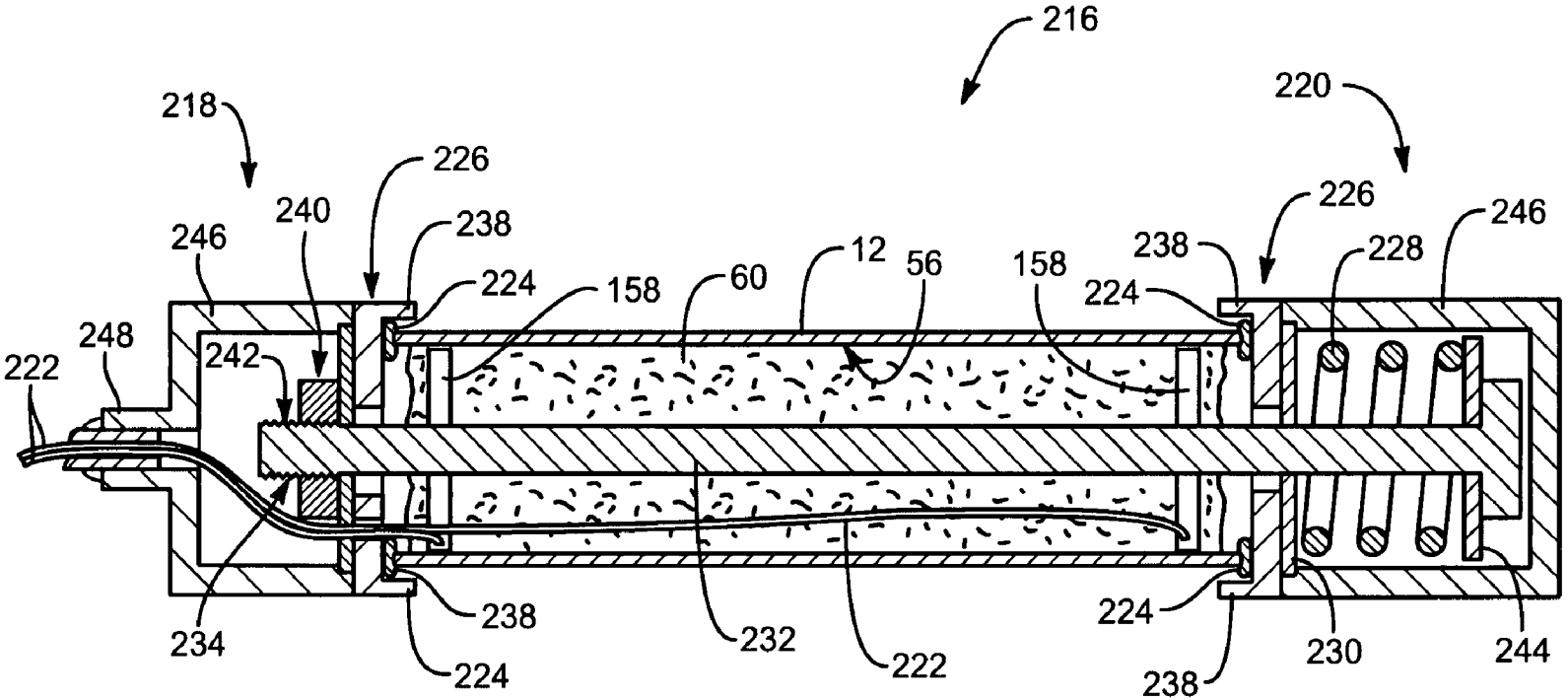
FIG. 19 is a side elevation, cross-sectional view of an alternative embodiment of an immersion heater in accordance with the present invention.

Referring to FIGS. 17–19, in certain embodiments, the interior surface 56 of a conduit 12 may be masked 104, roughened 106, coated 108, heat treated 110, terminated 112, conformally coated 122, or some combination there of, as discussed with respect to FIG. 5. Such an interior heating arrangement may allow embodiments in accordance with the present invention to heat fluids on the exterior of the conduit 12. For example, certain embodiments of the present invention may provide immersion heaters 216.

In selected embodiments, an immersion heater 216 may include a conduit 12 fitted with first and second end seals 218, 220 to form an enclosed unit. As has been presented hereinabove, a conduit 12 may be formed of any suitable material. Suitable materials for the conduit 12 may include quartz 196, corundum 198, glass 200, ceramic glass 202, ceramic 204, and the like. Electrical leads 170, 222 may enter an immersion heater 216 at any suitable location to provide a desired current to the conductive coating 60, 162. In one embodiment, electrical leads 170, 222 may be enshrouded and enter the immersion heater 216 through an end seal 218, 220.

Ends seals 218, 220 in accordance with the present invention may have any suitable shape or arrangement. In certain embodiments, end seal technology may be employed as disclosed in U.S. Pat. No. 5,971,402 issued Oct. 26, 1999 and entitled ULTRA-PURE, NON-REACTIVE, ELEVATED-TEMPERATURE SEAL ASSEMBLY, which is incorporated herein by reference. End seals as discussed in U.S. Pat. No. 5,971,402 may be applied to tubular members to heat fluids passing internally and externally thereto. For example, in one internal heating arrangement, end seals as discussed in U.S. Pat. No. 5,971,402 may be applied to tubular heaters such as those described in U.S. Pat. No. 6,376,816 issued Apr. 23, 2002 and entitled THIN FILM TUBULAR HEATER, which is incorporated herein by reference. In another embodiment, end seals as discussed in U.S. Pat. No. 5,971,402, incorporated herein by reference, may be used with heating circuits, such as those described in U.S. Pat. No. 6,376,816, incorporated herein by reference, positioned within a tubular member to created an arrangement for heating fluids passing externally thereto.

In one embodiment of an immersion heater 216, an end seal 218, 220 in accordance with the present invention may include a seal 224 urged by a header 226 against a respective end of a conduit 12. If desired, a biasing member 228 (e.g. a spring 228) may resiliently urge the end seals 218, 220 against the respective ends of the conduit 12. Load distributers 230 or pressure plates 230, interfacing members 232 or bolts 232, adjusters 234, shoulders 236, alignment mechanisms 238, and the like may be utilized as desired to facilitate application of the urging force to the end seals 218, 220.

For example, end seals 218, 220 may have alignment mechanisms 238 to facilitate alignment between the conduit 12, seal 224, and header 226. Alignment mechanisms 238 may extend proximate the interior of the conduit 12 as illustrated in FIGS. 17 and 18, proximate the exterior of the conduit 12 as illustrated in FIG. 19, proximate the interior and exterior, or may be omitted entirely. Headers 226 may have shoulders 236 formed therein to facilitate application of a force urging the end seals 218, 220 against the conduit 12. In certain embodiments, a shoulder 236 may provide a location for a load distributer 230 to engage or abut the header 226.

Load distributors 230 may be formed with any shape or material that effectively transfers the loads or forces applied by the biasing member 228 to the header 226. Apertures 239 may be positioned within a load distributor 230 to allow interfacing members 232 and electrical leads 22 to pass therethrough. Suitable materials for a load distributor 230 may include metals, metal alloys, polymers, composites, and the like. Load distributors 230 may be particularly useful when the material forming the header 226 is too flexible (or otherwise unsuitable) to properly distribute forces applied by the biasing member 228. If, however, a header 226 is formed of a material have sufficient strength, rigidity, and the like, a load distributor 230 may be omitted.

Interfacing members 232 may transfer forces generated by the biasing member 228 to the load distributor 230 or directly to the header 226. Various arrangements of interfacing members 232 and biasing member 228 may be employed with the scope of the present invention.

For example, in the embodiment illustrated in FIGS. 17 and 18, two interfacing members 232 are employed. Both interfacing members 232 extend from respective load distributors 230 toward the interior of the conduit 12. By connecting the two interfacing members 232 with a biasing member 228, a tensile force urging the end seals 218, 220 into abutment may be generated.

At least one of the interfacing members 230 may include an adjuster 234 arranged to facilitate assembly of the heater 216 as well as control the magnitude of the tensile force generated by the biasing member 228. In one embodiment, an adjuster 234 may be a nut 240 engaging the threads 242 on an interfacing member 232. By turning the nut 240 along the threads 242, the positioning of interfacing member 232 may be altered. Changing the position of the interfacing member 232 may increase or decrease the tensile loading of the biasing member 228.

In the embodiment illustrated in FIG. 19, one interfacing member 232 is employed. The interfacing member 232 may extend from a first load distributor 230*a* at one end of the conduit 12 through a second load distributor 230*b* at the other end of the conduit 12. In such an arrangement, a biasing member 228 may be positioned between the second load distributor 230*b* and the interfacing member 232. If desired, a washer 244 may assist the interface member 232 in engaging the biasing member 228. An adjuster 234 may be tightened (e.g. by threading) to load the biasing member 228 in compression, and thereby control the magnitude of the force maintaining the end seals 218, 220 in abutment with the conduit 12.

End seals 218, 220 in accordance with the present invention may be formed in multiple parts. For example, an end seal 218, 220 may included a closure 246, in addition to the header 226 and seal 224 already discussed. Removal of a closure 246 may provide access to the inner workings of an immersion heater 216 during assembly or repair. Application of a closure 246 may close the heater 216 and resist admittance of the fluids 210 in which the heater 216 is immersed. A closure 246 may threadingly engage a header 226 as illustrated in FIGS. 17 and 18 or may be welded to the header 226 as illustrated in FIG. 19.

Headers 226 and closures 246 in accordance with the present invention may be formed of any suitable material or combinations of materials. Material for headers 226 and closures 246 may be selected to provide desired chemical inactivity (non-reactivity, inertness), heat transfer, strength, rigidity, durability, and electrical, mechanical, or thermal expansion characteristics. Suitable materials may include fluoropolymers and the like (e.g. polytetrafluoroethylene (PTFE), perfluoroalkoxy (PFA), other materials sold under the trade name of TEFLON™). Similarly, a seal 224 in accordance with the present invention may be formed of any suitable material. Suitable materials for seals 224 may also include fluoropolymers and the like.

In certain embodiments, electrical leads 170, 222 may be delivered to an immersion heater 216 through a conduit 248. Such a conduit 248 may be formed of any suitable material providing the desired chemical inactivity, durability, and the like. In certain embodiments, the conduit 248 may be formed of a fluoropolymer. A conduit 248 may interface with an immersion heater 216 in any suitable manner. In one embodiment, the conduit 248 may threadingly engage an end seal 218, 220 and abut a sealing element 250, as illustrated in FIGS. 17 and 18. In an alternative embodiment, the conduit 248 may be welded (e.g. heat, ultrasound, etc.) to an end seal 218, 220, as illustrated in FIG. 19.

Figure 20:
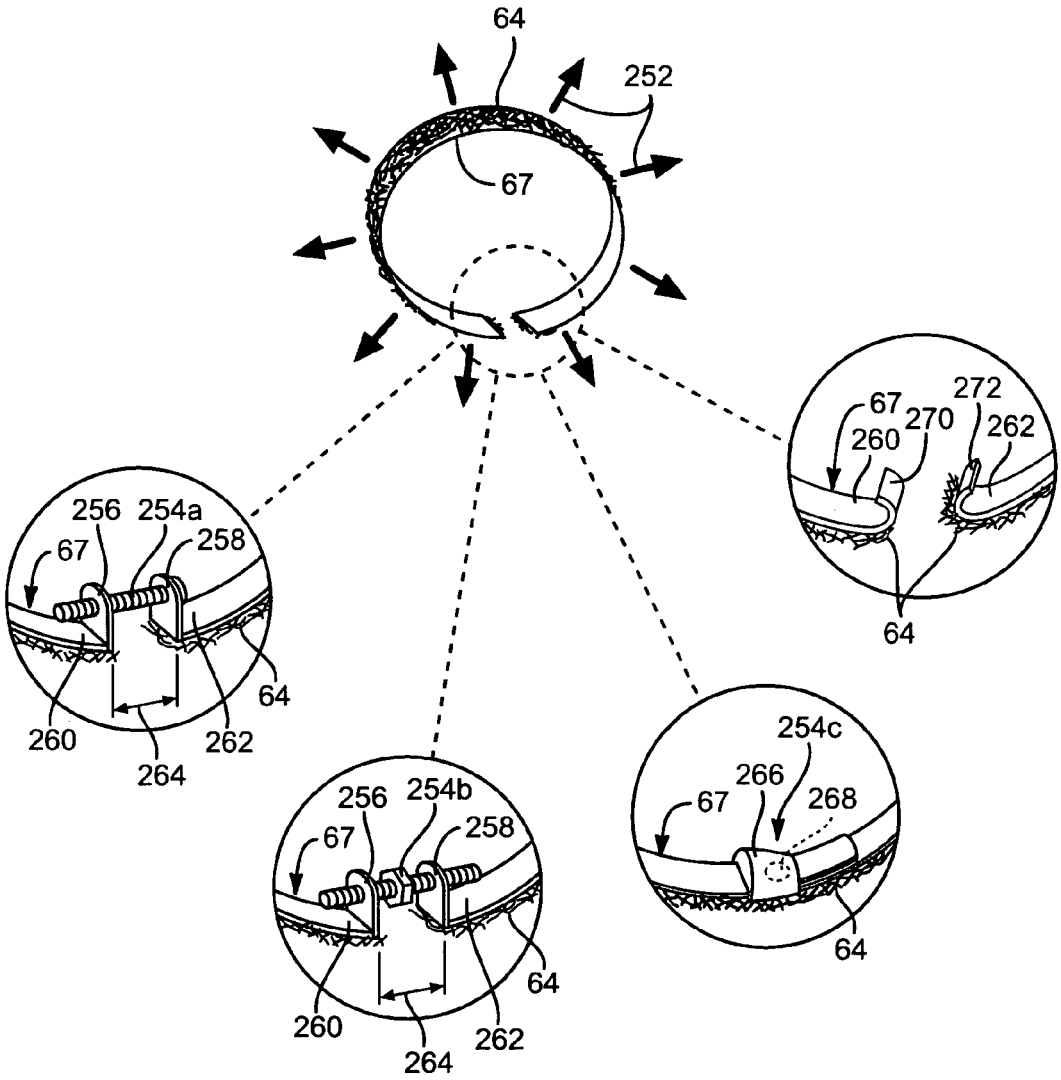
FIG. 20 is a perspective view of various clamp and conductor arrangements in accordance with the present invention.

Referring to FIG. 20, a termination 158 for a conductive coating 60, 162 extending on an interior surface 56 may be similar in operation and structure to a termination 158 extending on an exterior surface 54. End coatings 62, interface layers 63, 164, conductors 64, 166, clamps 67, 168 or any combinations thereof may be applied to an interior surface 56 in a manner similar to that used when applied to an exterior surface 54. For example, a clamp 67, 168 may be arranged to exert an outwardly extending, radial force 252. In embodiments where the conduit 12 confines the clamp 67, 168 within a region smaller that the resting position thereof, the resiliency of the clamp 67, 168 may generate the radial force 252. In other embodiments, a mechanical device 254 may adjust the circumference of the clamp 67, 168 and, thereby, adjust the radial force 252 applied to the conduit 12.

In certain embodiments, a mechanical device 254 may be a screw 254*a* engaging tabs 256, 258 extending from opposing ends 260, 262 of the clamp 67, 168. By turning the screw 254*a*, the distance 264 between the ends 260, 262 may be increased or decreased to correspondingly increase or decrease the radial force 252. In another embodiment, the mechanical device 254 may be a multiple-thread screw 245*b* employing both right and left handed threads. A multiple-thread screw 245*b* may draw the ends 260, 262 together or push them apart, depending on the direction of rotation imposed. While provided the same result as the standard screw 254*a*, a multiple-thread screw 254*b* may provide advantages with respect to ease of access for inducing rotation.

In selected embodiments, a mechanical device 254 may be a friction stop 254*c*. A friction stop 254*c* may include a ramped housing 266 connected to a first end 262 of the clamp 67, 168. The second end 260 of the clamp 67, 168 may loop around and pass through the ramped housing 266. A ball 268 or roller 268 may be contained with the ramped housing 266 such that when the second end 260 is pushed therethrough, the ball 268 becomes wedged and resists further insertion of the second end 260. A friction stop 254*c* may operate as a one-way latch resisting reductions in the circumference of the clamp 67, 168. Once a desired radial force 252 is achieved, the friction stop 254*c* may resist any decreases in circumference tending to reduce the force 252.

In certain embodiments, opposing ends 260, 262 of the clamp 67, 168 may be treated or altered to resist damaging the underlying material (e.g. end coating 62, interface layers 63, 164, or conductors 64, 166). For example, the ends 260, 262 may bend back over themselves to form blunt ends 270, 272. In certain embodiments employing a mechanical device 254 to control and adjust the radial force 252, the transition between the clamp 67, 168 and the tabs 256, 258 may be rounded to resist gouging.

As discussed hereinabove, a clamp 67, 168 may apply a mechanical load 169 (e.g. radial force 252) to the conductor 64, 166 to ensure an effective electrical contact between a conductor 64, 166 and an underlying material (e.g. end coating 62, interface layer 63, 164, or conductive coating 60, 162). If a clamp 676, 168 is formed of a conductive material, a lead 170, 222 in intimate contact therewith may deliver an electrical load to the conductor 64, 166. In other embodiments, a lead 170, 222 may contact a conductor 64, 166 directly.

In certain embodiments, a conductor 64, 166 applied to immersion heaters 216 may be formed to provide mechanical load distribution. For example, the conductor 64, 166 may be formed of multiple strands 174 crimped, bent, twisted, woven, or otherwise formed to produce multiple points of contact between themselves and the clamp 67, 168 and/or between themselves and the underlying material (e.g. end coating 62, interface layer 63, 164, or conductive coating 60, 162). In such a configuration, the strands 174 and the leaf springs 176 formed therein, may distribute mechanical loads 169 applied by the clamp 67, 168.

Figure 21:
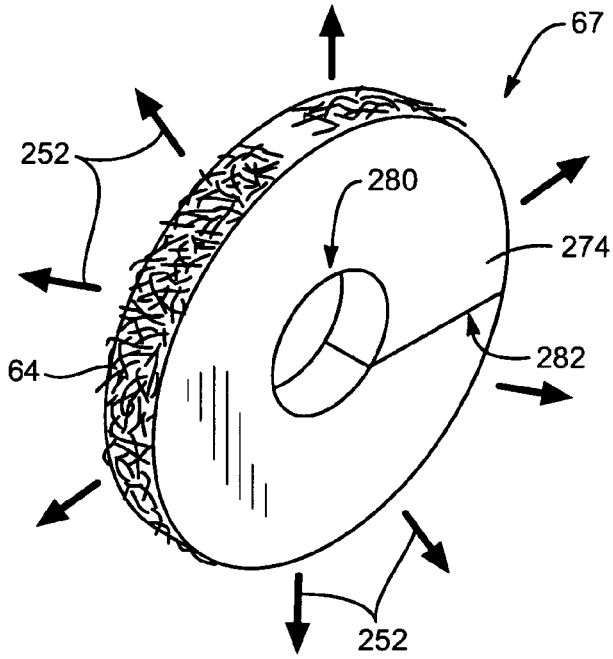
FIG. 21 is a perspective view of an alternative embodiment of a clamp and conductor in accordance with the present invention.
Figure 22:
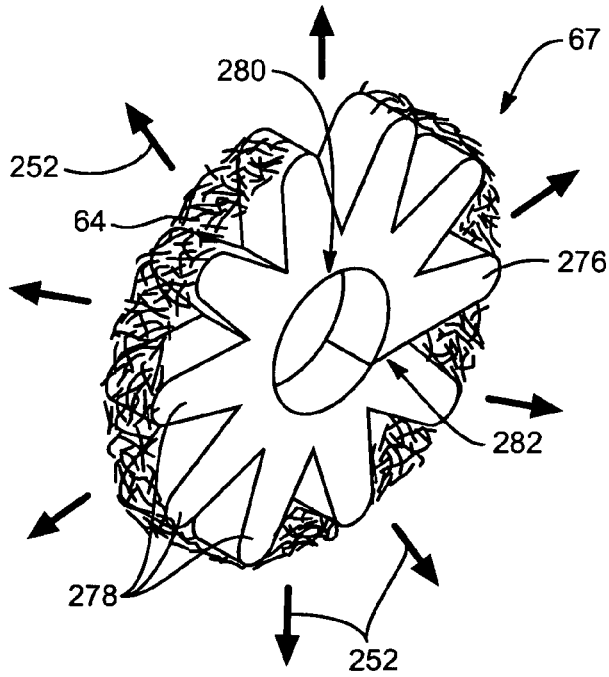
FIG. 22 is a perspective view of another alternative embodiment of a clamp and conductor in accordance with the present invention.

Referring to FIGS. 21 and 22, a clamp 67, 168 for a termination 158 applied to an interior surface 56 may have any suitable shape. As discussed hereinabove, such a clamp 67, 168 may be formed as a circumferentially extending band. In other embodiments, a clamp 67, 168 may be formed as a disk 274. For example, a clamp 67, 168 may be a disk 274 shaped to occupy a cross-section of the conduit 12 and urge a conductor 64, 166 against an underlying material (e.g. end coating 62, interface layer 63, 164, or conductive coating 60, 162) applied to the interior surface 56 of the conduit 12. A disk 274 may urge continuous contact between a conductor 64, 166 and the underlying material.

In selected embodiments, a discontinuous contact between a conductor 64, 166 and an underlying material (e.g. end coating 62, interface layer 63, 164, or conductive coating 60, 162) may be acceptable or even desired. In such embodiments, a clamp 67, 168 shaped as a star 276 may be used. A star 276 may have various extensions 278 extending radially to urge a conductor 64, 166 in contact with the underlying material at selected locations.

Clamps 67, 168 shaped as disks 274, stars 276, and the like may have apertures 280 formed therein to permit electrical leads, 170, 222, biasing member 228, interfacing members 232, and the like to extend therethrough. Disks 274, stars 276, and the like may be formed of any suitable material. Suitable materials may include metals, metal alloys, polymers, composites, and elastomers. Suitable materials may be electrically conducting as well as electrically non-conducting. In selected embodiments, disks 274, stars 276, and the like may be formed of a resilient material (e.g. an elastomer) to provide a biasing force urging a conductor 64, 166 into proper abutment. In disks 274, stars 276, and the like formed of resilient materials, a slit 282 may be formed therein to facilitate admittance of selected components through the aperture 280.

Figure 23:
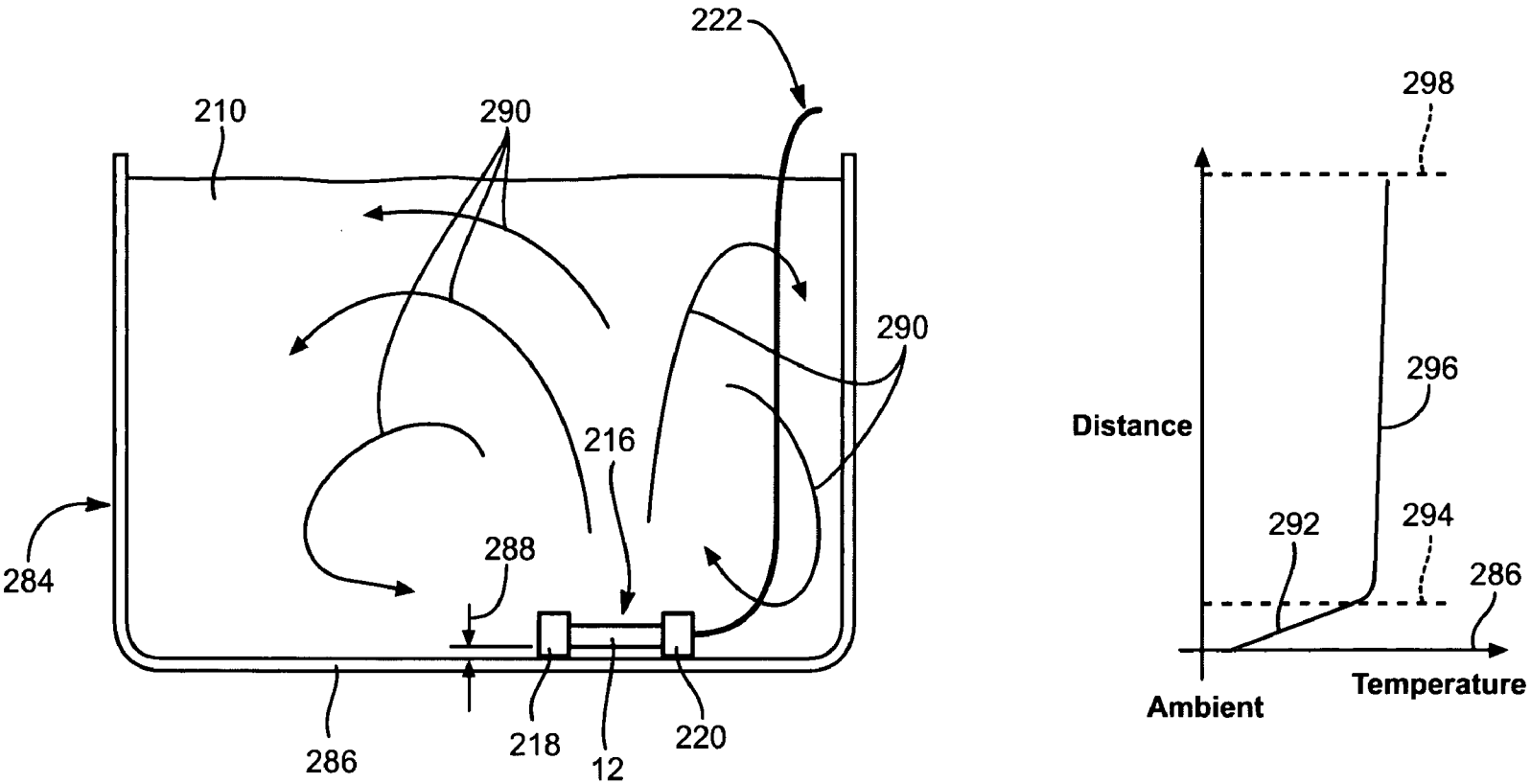
FIG. 23 is an elevation, cross-sectional view of a tank and immersion heater in accordance with the present invention illustrating potential temperature gradients and convection currents.

Referring to FIG. 23, when placed within a tank 284 containing a selected fluid 210 (e.g. acid, DI, and the like), an immersion heater 216 in accordance with the present invention may settle on the bottom 286. In certain embodiments, the end seals 218, 220 may have a diameter greater than that of the conduit 12. As a result, when positioned in the tank 284, the conduit 12 may be spaced a selected distance 288 from the bottom 286. This spacing 288 may permit fluid 210 to contact all heated surfaces of the conduit 12 and provide a substantially even heat flux from the conduit 12 to the fluid 210.

In operation, resistance to the current passed through the conductive coating 60, 162 located on the interior surface 56 of the conduit 12 generates heat. This heat is conducted from the conductive coating 60, 162 to the wall of the conduit 12. The heat travels through the wall to the fluid interface surface (i.e. exterior surface 54), and is conducted to the fluid 210 in the immediate vicinity of the heater 216. The resulting differentials in temperature within the fluid 210 cause convection currents 290. Warmer fluids 210 rise away from the heater while cooler fluids 210 sink toward the heater 216 at the bottom 286.

Convection currents 290 mix the fluid 210 within the tank 284. While there may be a significant temperature gradient 292 between the bottom 286 of the tank 284 and the top 294 of the heater 216, the temperature gradient 296 between the top 294 of the heater 216 and the top 298 of the fluid in the tank 284 may be small. Thus, the majority of the fluid 210 within the tank 284 may be available for use at a substantially uniform temperature, typically within one or two degrees Centigrade. The temperature gradient across a heater may be dramatic, rising from substantially ambient to the bulk tank temperature 219. The temperature of the fluid 219 may be controlled by adjusting the current applied to the immersion heater 216. The temperature of the fluid 219 may also be controlled by increasing or decreasing the number of immersion heaters 216 placed within the tank 284.

Figure 24:
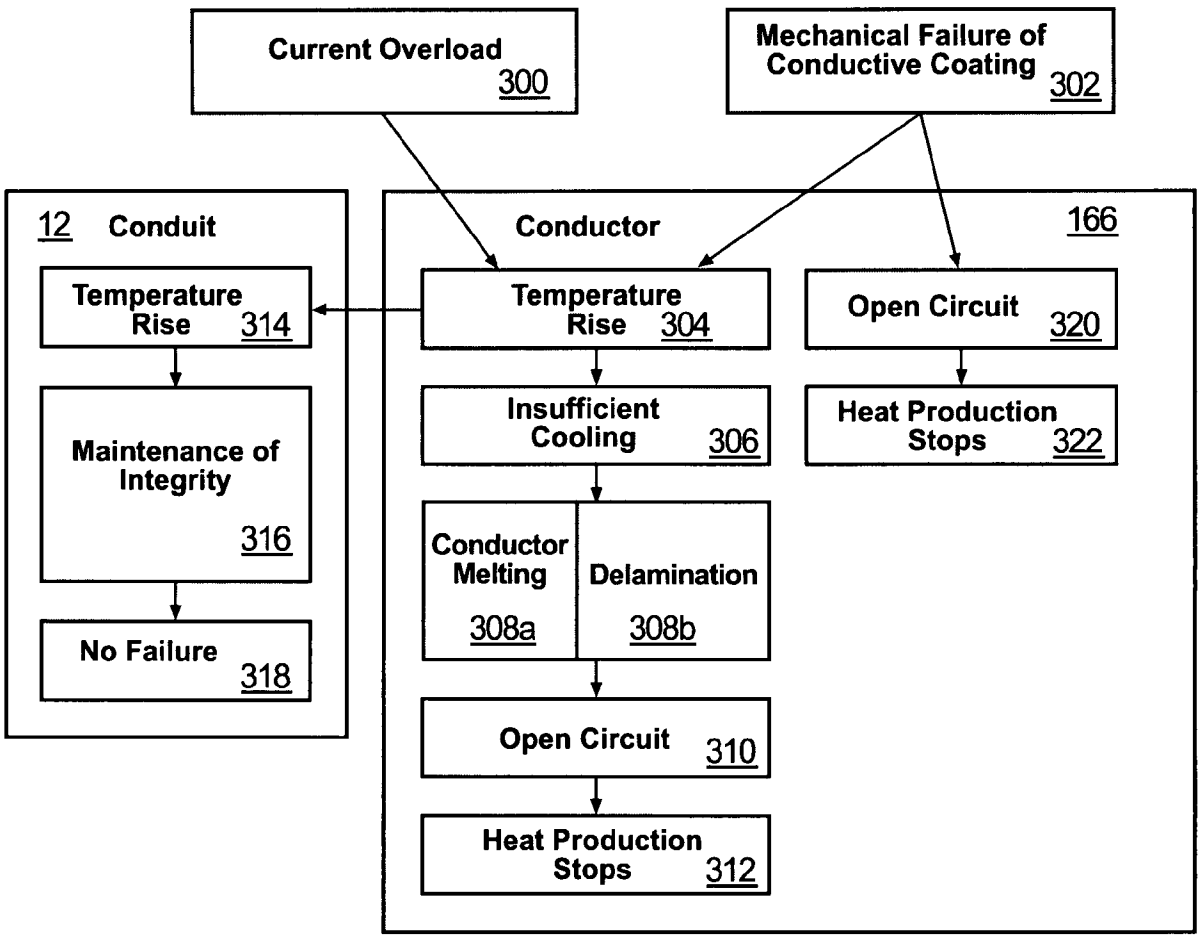
FIG. 24 is a schematic block diagram illustrating the fail-safe progression of certain immersion heaters in accordance with the present invention.

Referring to FIG. 24, immersion heaters 216 in accordance with the present invention may be made fail-safe. For example, immersion heaters 216 may be arranged to accommodate current overload 300 and mechanical failure 302 of the conductive coating 60, 162 without exposing the inner workings of the heater 216 to the fluid 210.

Current overload 300 may result in a temperature rise 304 in the conductor 60, 162. If the temperature rise is significant, the fluid 210 surrounding the heater 216 may provide insufficient cooling 306. Insufficient cooling 306 may, in turn, result in a continued temperature rise in the conductive coating 60, 162. Upon reaching a sufficient temperature, failure of the conductive coating 60, 162 may occur in one of two ways. The conductive coating 60, 162 may melt 308*a* or delaminate 308*b* (completely or partially) from the conduit 12. The two modes of failure 308*a*, 308*b* may occur at different temperatures. For example, melting 308*a* may occur at a lower temperature that delamination 308*b* and, thereby, preclude delamination 308*b*. Delamination 308*b* reduces cooling and will typically also result in melting. The resulting loss of conduction may overload the remainder of the adjacent circumference. Heating may then completely open that circuit.

Both modes of failure 308*a*, 308*b* may result in an open circuit 310 after which no additional heat 312 may be generated. In the possibility that a delamination 308*b* occurs without creating an open circuit 310, the temperature of the conductive coating 60, 162 may continue to rise until it melts 308*a*, creating an open circuit 310.

Temperature rise 304 of the conductive coating 60, 162 may cause a temperature rise 314 bin the conduit 12. However, due to the high melting point of the conduit 12 (e.g. sapphire melts at 2323 K, quartz melts at 1883 K, etc.), the conductive coating 60, 162 will melt 308*a*, open the circuit 310, and stop heat production 312 long before the mechanical properties of the conduit 12 are diminished. As a result, the integrity of the conduit 12 and end seals 218, 220 is maintain 316. No failure 318 permitting fluid 210 to contact the inner workings of the immersion heater 216 may occur.

Similarly, a mechanical failure 302 (e.g. delamination, partial delamination) of the conductive coating 60, 162 will not result in a failure that allows fluid 210 to contact the inner workings of the immersion heater 216. A mechanical failure 302 may result in a temperature rise 304 in the conductive coating 60, 162. As discuss hereinabove, temperature rise 304 of the conductive coating 60, 162 does not compromise the integrity of the conduit 12 and end seals 218, 220. A mechanical failure 302 may also result in an open circuit 320 from which no additional heat may be generated 322.

From the above discussion, it will be appreciated that the present invention provides apparatus and methods for heating ultra pure fluids in a hyper-clean or ultra-pure environment. Power densities are comparatively very high, while heater reliability is superior and fail-safe. Meanwhile, manufacturing is rapid yet reliable, and adjustments are available to produce high yields of highly predictable product.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A heater comprising:

a substrate formed of corundum having a wall defining a first surface separated from a second surface by a thickness;

the substrate being corundum;

the substrate wherein at least a portion of the first surface has been abraded to form a roughened region; and a conductor, extending on and adhering to the roughened region, the conductor being electrically resistive and comprising nickel.

2. The heater of claim 1, wherein the substrate has been mechanically abraded.

3. The heater of claim 2, wherein the substrate is formed as a conduit having a tubular cross-section.

4. The heater of claim 3, wherein the conductor is deposited onto the substrate at a thickness characteristic of a process selected from spraying, sintering, flame spraying, vapor deposition, sputtering, electroless plating, and electrolytic plating.

5. The heater of claim 4, further comprising an anti-oxidation coating over at least a portion of the conductor to reduce oxidation at elevated temperatures.

6. The heater of claim 5, further comprising a transmission line in electrical connection with the conductor.

7. The heater of claim 6, wherein mechanical abrasion is selected from blasting and grinding.

8. The heater of claim 7, wherein the first surface forms the exterior of the conduit and the second surface forms the interior of the conduit.

9. The heater of claim 7, wherein the first surface forms the interior of the conduit and the second surface forms the exterior of the conduit.

10. The heater of claim 1, wherein the substrate is formed of a single crystal of synthetic sapphire to be a conduit having a tubular shape.

11. The heater of claim 1, wherein the conductor is deposited onto the substrate at a thickness characteristic of a process selected from spraying, sintering, flame spraying, vapor deposition, sputtering, electroless plating, and electrolytic plating.

12. The heater of claim 1, further comprising an anti-oxidation coating over at least a portion of the conductor to reduce oxidation at elevated temperatures.

13. The heater of claim 1, further comprising first and second transmission lines in electrical connection with the conductor.

14. The heater of claim 1, wherein the substrate is formed as a conduit, the first surface forms the exterior of the conduit and the second surface forms the interior of the conduit.

15. The heater of claim 1, wherein the substrate is formed as a conduit, the first surface forms the interior of the conduit and the second surface forms the exterior of the conduit.

16. A heater comprising:

a conduit made of a single crystal of synthetic sapphire having a wall, an interior surface, and an exterior surface, the conduit having a closed cross section;

at least one of the interior and exterior surfaces having a roughened portion comprising inclusions and corresponding protrusions formed substantially continuously therethroughout; and an electrically resistive coating comprising nickel extending substantially continuously over, in, and around the inclusions and protrusions of at least a part of the roughened portion to form a conformal cross-section having a thickness selected to promote bending thereof to accommodate annular expansion and contraction occurring in response to a differential in the coefficients of expansion between the electrically resistive coating and the conduit.

17. A method for adhering an electrically resistive coating, the method comprising:

selecting a substrate formed of corundum and having have an interior surface separated from an exterior sure by a thickness;

modifying a portion of at least one of the interior and exterior surfaces by mechanical abrasion to provide a textured region having inclusions with sharp edges; and applying a coating comprising nickel configured to be electronically resistive, to extend over at least a portion of the textured region, and to adhere to the textured region by micro-mechanical gripping of the inclusions under stresses due to a differential in respective coefficients of thermal expansion thereof.

* * * * *